US010934787B2

(12) United States Patent
Bansal et al.

(10) Patent No.: US 10,934,787 B2
(45) **Date of Patent: *Mar. 2, 2021**

(54) MILLING SYSTEM FOR ABANDONING A WELLBORE

(71) Applicant: Weatherford Technology Holdings, LLC, Houston, TX (US)

(72) Inventors: Ram K. Bansal, Houston, TX (US); Mohammed Aleemul Haq, Houston, TX (US); Thomas F. Bailey, Abilene, TX (US); Richard J. Segura, Broussard, LA (US); Ian Smith, Aberdeen (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 15 days.

This patent is subject to a terminal disclaimer.

(21) Appl. No.: 15/940,507

(22) Filed: Mar. 29, 2018

(65) Prior Publication Data

US 2018/0216419 A1 Aug. 2, 2018

Related U.S. Application Data

(63) Continuation of application No. 14/496,936, filed on Sep. 25, 2014, now Pat. No. 9,938,781.
(Continued)

(51) Int. Cl.
*E21B 17/10* (2006.01)
*E21B 29/00* (2006.01)
(Continued)

(52) U.S. Cl.
CPC ..... *E21B 17/1014* (2013.01); *E21B 29/002* (2013.01); *E21B 33/13* (2013.01); *E21B 47/095* (2020.05)

(58) Field of Classification Search
CPC .... E21B 33/12; E21B 33/10; E21B 2034/007; E21B 33/08; E21B 33/16; E21B 34/14
See application file for complete search history.

(56) References Cited

U.S. PATENT DOCUMENTS 1,801,482 A 4/1931 Boynton
1,844,370 A 2/1932 Santiago
(Continued)

FOREIGN PATENT DOCUMENTS

EP 0385673 A1 9/1990
EP 0916803 A2 5/1999
(Continued)

OTHER PUBLICATIONS

EPO Office Action dated Jul. 12, 2018, for European Application No. 14787075.2.
(Continued)

*Primary Examiner* — Tara Schimpf
*Assistant Examiner* — Manuel C Portocarrero
(74) *Attorney, Agent, or Firm* — Patterson + Sheridan, LLP

(57) ABSTRACT

A mill for use in a wellbore includes a tubular housing having a bore therethrough and a plurality of eccentrically arranged pockets formed in a wall thereof and an arm disposed in each pocket. Each arm has a body portion and a blade portion extending from an outer surface of the body portion and is movable between an extended position and a retracted position. The mill further includes cutters disposed along each blade portion and a block disposed in each pocket and connected to the housing. Each block has a guide engaged with a mating guide of the respective body portion and an inner passage for providing fluid communication between the housing bore and the respective pocket. The mill further includes an actuator for extending the arms.

22 Claims, 21 Drawing Sheets

Related U.S. Application Data

(60) Provisional application No. 61/903,230, filed on Nov. 12, 2013, provisional application No. 61/889,867, filed on Oct. 11, 2013.

(51) Int. Cl.

| | |
|---|---|
| ***E21B 33/13*** | (2006.01) |
| ***E21B 47/09*** | (2012.01) |
| ***E21B 33/12*** | (2006.01) |
| ***E21B 33/10*** | (2006.01) |
| ***E21B 33/08*** | (2006.01) |
| ***E21B 33/16*** | (2006.01) |
| ***E21B 33/14*** | (2006.01) |
| ***E21B 33/05*** | (2006.01) |
| ***E21B 33/124*** | (2006.01) |
| ***E21B 47/095*** | (2012.01) |

(56) References Cited

U.S. PATENT DOCUMENTS

| | | | |
|---|---|---|---|
| 1,867,289 | A | 7/1932 | Ventresca |
| 2,481,637 | A | 9/1949 | Yancey |
| 2,572,997 | A | 10/1951 | Edwards |
| 2,735,485 | A | 2/1956 | Metcalf, Jr. |
| 2,761,196 | A | 9/1956 | Graves et al. |
| 2,846,193 | A | 8/1958 | Chadderdon |
| 2,899,000 | A | 8/1959 | Medders et al. |
| 3,110,084 | A | 11/1963 | Kinzbach |
| 3,283,405 | A | 11/1966 | Braswell |
| 3,331,439 | A | 7/1967 | Lawrence |
| 3,351,134 | A | 11/1967 | Kammerer |
| 3,396,795 | A | 8/1968 | Venghiattis |
| 3,419,077 | A | 12/1968 | Sanford |
| 4,284,154 | A | 8/1981 | England |
| 4,431,065 | A | 2/1984 | Andrews |
| 4,565,252 | A | 1/1986 | Campbell et al. |
| 4,710,074 | A | 12/1987 | Springer |
| 4,717,290 | A | 1/1988 | Reynolds et al. |
| 4,889,197 | A | 12/1989 | Boe |
| 4,938,291 | A | 7/1990 | Lynde et al. |
| 5,012,863 | A | 5/1991 | Springer |
| 5,027,914 | A | 7/1991 | Wilson |
| 5,035,293 | A | 7/1991 | Rives |
| 5,036,921 | A | 8/1991 | Pittard et al. |
| 5,058,666 | A | 10/1991 | Lynde et al. |
| 5,060,738 | A | 10/1991 | Pittard et al. |
| 5,074,355 | A | 12/1991 | Lennon |
| 5,150,755 | A | 9/1992 | Cassel et al. |
| 5,242,017 | A | 9/1993 | Hailey |
| 5,318,137 | A | 6/1994 | Johnson et al. |
| 5,318,138 | A | 6/1994 | Dewey et al. |
| 5,332,048 | A | 7/1994 | Underwood et al. |
| 5,341,888 | A | 8/1994 | Deschutter |
| 5,373,900 | A | 12/1994 | Lynde et al. |
| 5,392,858 | A | 2/1995 | Peters et al. |
| 5,447,207 | A | 9/1995 | Jones |
| 5,532,048 | A | 7/1996 | Klocek et al. |
| 5,560,440 | A | 10/1996 | Tibbitts |
| 5,582,260 | A | 12/1996 | Murer et al. |
| 5,620,051 | A | 4/1997 | Carter et al. |
| 5,771,942 | A | 6/1998 | Bunger |
| 5,771,972 | A | 6/1998 | Dewey et al. |
| 5,887,668 | A | 3/1999 | Haugen et al. |
| 5,899,268 | A | 5/1999 | Lynde et al. |
| 5,908,071 | A | 6/1999 | Hutchinson et al. |
| 5,979,571 | A | 11/1999 | Scott et al. |
| 5,984,005 | A | 11/1999 | Hart et al. |
| 6,009,961 | A | 1/2000 | Pietrobelli et al. |
| 6,125,929 | A | 10/2000 | Davis et al. |
| 6,155,349 | A | 12/2000 | Robertson et al. |
| 6,202,752 | B1 | 3/2001 | Kuck et al. |
| 6,206,111 | B1 | 3/2001 | Nistor |
| 6,357,528 | B1 | 3/2002 | Davis et al. |
| 6,378,632 | B1 | 4/2002 | Dewey et al. |
| 6,401,821 | B1 | 6/2002 | Kennedy et al. |
| 6,568,492 | B2 | 5/2003 | Thigpen et al. |
| 6,612,383 | B2 | 9/2003 | Desai et al. |
| 6,679,328 | B2 | 1/2004 | Davis et al. |
| 6,732,817 | B2 | 5/2004 | Dewey et al. |
| 6,920,923 | B1 | 7/2005 | Pietrobelli et al. |
| 7,143,848 | B2 | 12/2006 | Armell |
| 7,178,609 | B2 | 2/2007 | Hart et al. |
| 7,314,099 | B2 | 1/2008 | Dewey et al. |
| 7,370,712 | B2 | 5/2008 | Stout et al. |
| 7,506,703 | B2 | 3/2009 | Campbell et al. |
| 7,624,818 | B2 | 12/2009 | McClain et al. |
| 7,891,441 | B2 | 2/2011 | Lee |
| 7,909,100 | B2 | 3/2011 | Bryant, Jr. et al. |
| 7,954,570 | B2 | 6/2011 | McClain et al. |
| 8,082,988 | B2 | 12/2011 | Redlinger et al. |
| 8,540,035 | B2 | 9/2013 | Xu et al. |
| 8,555,955 | B2 | 10/2013 | Davis |
| 9,022,117 | B2 | 5/2015 | Segura et al. |
| 9,695,660 | B2 | 7/2017 | Ruttley |
| 9,938,781 | B2 * | 4/2018 | Bansal ..... E21B 29/002 |
| 10,344,548 | B2 | 7/2019 | Ruttley et al. |
| 2002/0144815 | A1 | 10/2002 | Van Drentham-Susman et al. |
| 2003/0079913 | A1 | 5/2003 | Eppink et al. |
| 2004/0134687 | A1 | 7/2004 | Radford et al. |
| 2004/0206547 | A1 | 10/2004 | de Luca |
| 2004/0245020 | A1 | 12/2004 | Giroux et al. |
| 2005/0039905 | A1 | 2/2005 | Hart et al. |
| 2005/0274546 | A1 | 12/2005 | Fanuel et al. |
| 2007/0163809 | A1 | 7/2007 | Mackay et al. |
| 2008/0115972 | A1 | 5/2008 | Lynde et al. |
| 2008/0115973 | A1 | 5/2008 | Rives |
| 2008/0169107 | A1 | 7/2008 | Redlinger et al. |
| 2009/0145666 | A1 | 6/2009 | Radford et al. |
| 2009/0266544 | A1 | 10/2009 | Redlinger et al. |
| 2010/0006290 | A1 | 1/2010 | Saylor, III et al. |
| 2010/0065264 | A1 | 3/2010 | Nackerud |
| 2010/0126715 | A1 | 5/2010 | Dithmar et al. |
| 2010/0276201 | A1 | 11/2010 | Makkar et al. |
| 2011/0127044 | A1 | 6/2011 | Radford et al. |
| 2011/0220357 | A1 | 9/2011 | Segura et al. |
| 2011/0278064 | A1 | 11/2011 | Rasheed |
| 2012/0152543 | A1 | 6/2012 | Davis |
| 2012/0186823 | A1 | 7/2012 | Xu |
| 2012/0325480 | A1 | 12/2012 | Schmidt et al. |
| 2013/0292108 | A1 * | 11/2013 | Hutchinson ..... E21B 29/005 166/55.8 |
| 2014/0332200 | A1 | 11/2014 | Ruttley |
| 2015/0101812 | A1 | 4/2015 | Bansal et al. |
| 2015/0275606 | A1 | 10/2015 | Segura et al. |
| 2016/0130899 | A1 | 5/2016 | Cronley |

FOREIGN PATENT DOCUMENTS

| | | | |
|---|---|---|---|
| GB | 872547 | A | 7/1961 |
| GB | 2262711 | A | 6/1993 |
| GB | 2352747 | A | 2/2001 |
| GB | 2420359 | A | 5/2006 |
| GB | 2461639 | A | 1/2010 |
| GB | 2486898 | A | 7/2012 |
| WO | 9319281 | A1 | 9/1993 |
| WO | 9711250 | A1 | 3/1997 |
| WO | 02079604 | A2 | 10/2002 |
| WO | 07/11250 | A1 | 1/2007 |
| WO | 2014150524 | A2 | 9/2014 |

OTHER PUBLICATIONS

Weatherford International Ltd.—"A-1 Section Mill" brochure, 2005, 6 pages.

PCT Search Report and Written Opinion for International Application No. PCT/US2014/059462 dated May 20, 2015.

Australian Patent Examination Report dated Jul. 20, 2016, for Australian Patent Application No. 2014332108.

EPO Office Action dated Sep. 9, 2019, for European Application No. 14787075.2.

EPO Office Action dated Apr. 26, 2019, for European Application No. 14787075.2.

(56) References Cited

OTHER PUBLICATIONS

EPO Office Action dated Oct. 23, 2019, for European Application No. 14787075.2.

* cited by examiner

FIG. 4F
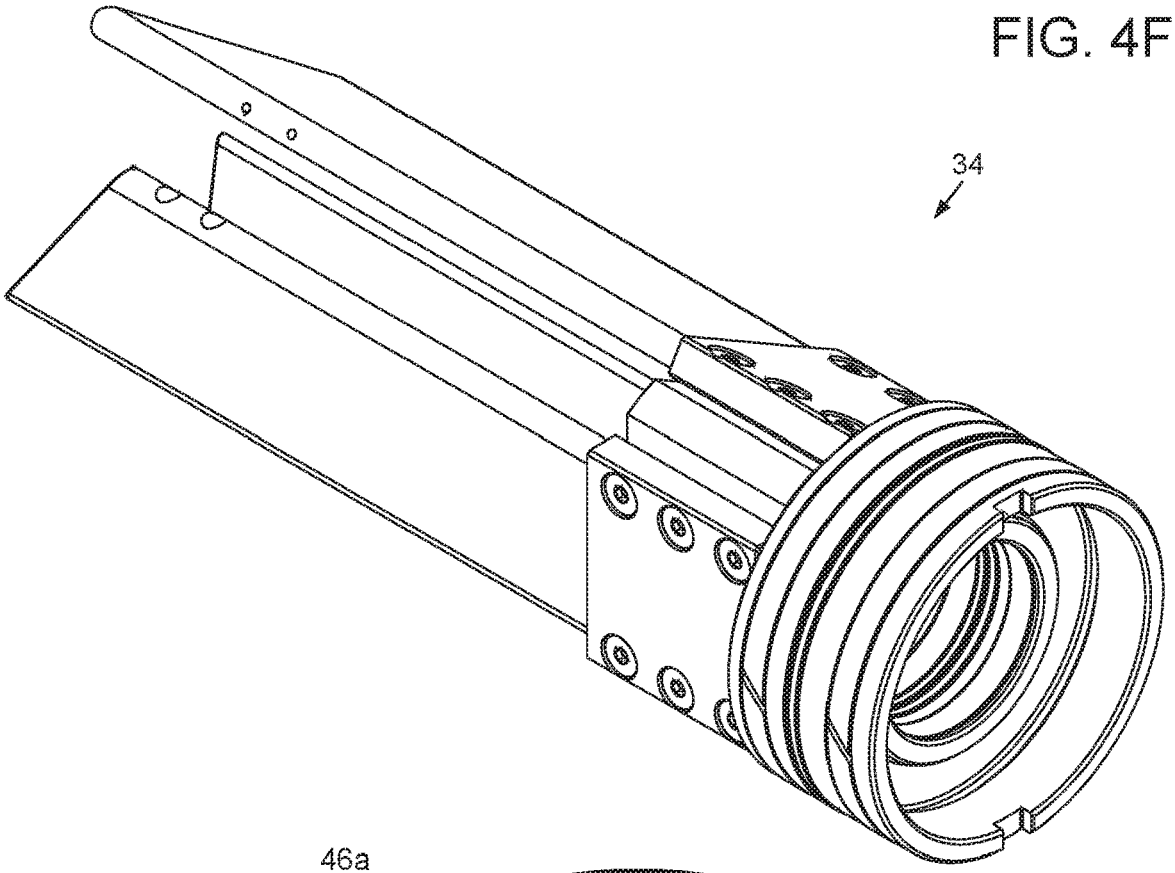
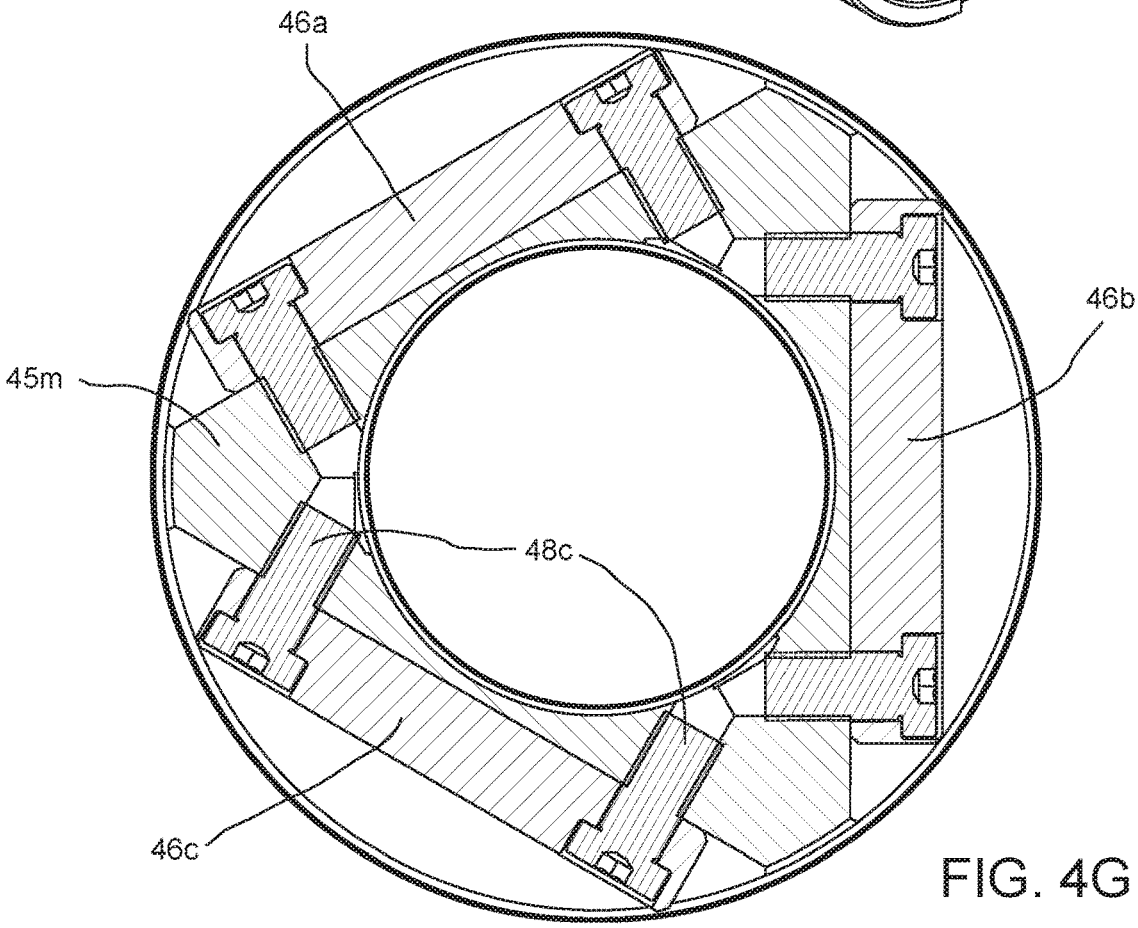
FIG. 4G

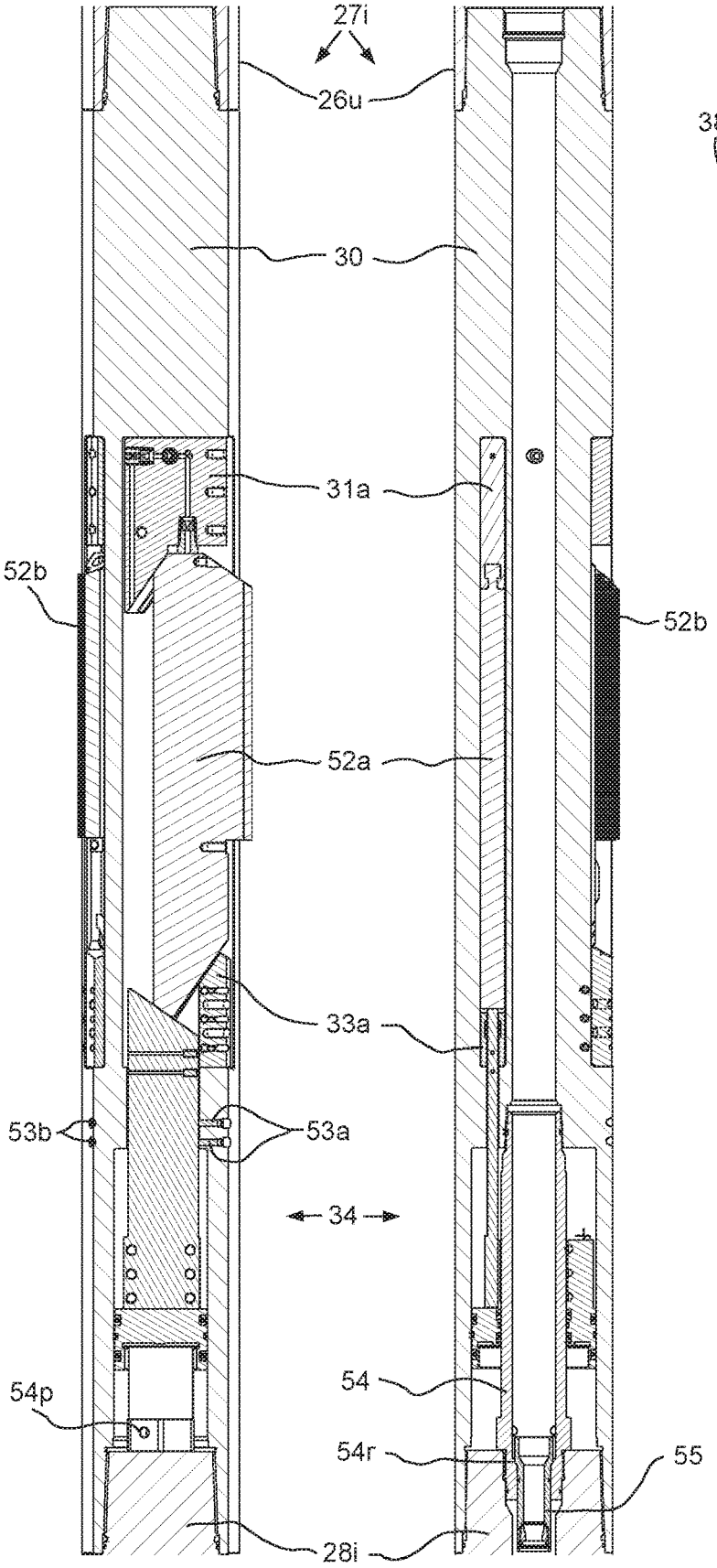
FIG. 6A
FIG. 6B
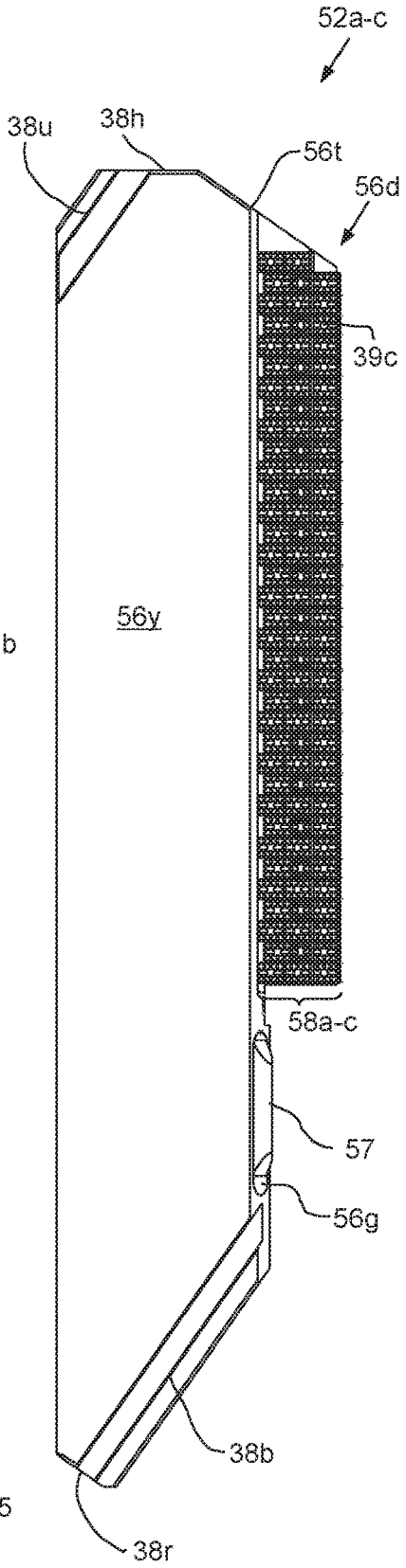
FIG. 6C

MILLING SYSTEM FOR ABANDONING A WELLBORE

CROSS-REFERENCE TO RELATED APPLICATIONS

This Application is a Continuation of application Ser. No. 14/496,936 filed on Sep. 25, 2014. Application Ser. No. 14/496,936 claims the benefit of U.S. Provisional Application 61/903,230 filed on Nov. 12, 2013. Application Ser. No. 14/496,936 claims the benefit of U.S. Provisional Application 61/889,867 filed on Oct. 11, 2013.

BACKGROUND OF THE DISCLOSURE

Field of the Disclosure

The present disclosure generally relates to a milling system for abandoning a wellbore.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with the drill string. The drill string is removed. A first string of casing is then run into the wellbore and set in the drilled out portion of the wellbore, and cement is circulated into the annulus behind the casing string. Next, the well is drilled to a second designated depth, and a second string of casing or liner, is run into the drilled out portion of the wellbore. If the second string is a liner string, the liner is set at a depth such that the upper portion of the second string of casing overlaps the lower portion of the first string of casing. The liner string may then be fixed, or "hung" off of the existing casing by the use of slips which utilize slip members and cones to frictionally affix the new string of liner in the wellbore. The second casing or liner string is then cemented. This process is typically repeated with additional casing or liner strings until the well has been drilled to total depth. In this manner, wells are typically formed with two or more strings of casing/liner of an ever-decreasing diameter.

Once the hydrocarbon formations have been depleted, the wellbore must be plugged and abandoned (P&A) using cement plugs. This P&A procedure seals the wellbore from the environment, thereby preventing wellbore fluid, such as hydrocarbons and/or salt water, from polluting the surface environment. This procedure also seals sensitive formations, such as aquifers, traversed by the wellbore from contamination by the hydrocarbon formations. Setting of a cement plug when there are two adjacent casing strings lining the wellbore is presently done by perforating the casing strings and squeezing cement into the formation. This procedure sometimes does not give a satisfactory seal because wellbore fluid can leak to the surface through voids and cracks formed in the cement.

Applicant's own US 2011/0220357 discloses a section mill and method for abandoning a wellbore.

SUMMARY OF THE DISCLOSURE

The present disclosure generally relates to a milling system for abandoning a wellbore. In one embodiment, a mill for use in a wellbore includes a tubular housing having a bore therethrough and a plurality of eccentrically arranged pockets formed in a wall thereof and an arm disposed in each pocket. Each arm has a body portion and a blade portion extending from an outer surface of the body portion and is movable between an extended position and a retracted position. The mill further includes cutters disposed along each blade portion and a block disposed in each pocket and connected to the housing. Each block has a guide engaged with a mating guide of the respective body portion and an inner passage for providing fluid communication between the housing bore and the respective pocket. The mill further includes an actuator for extending the arms.

In another embodiment, a bottomhole assembly (BHA) for use in a wellbore includes: a window mill; a section mill; and a stabilizer. The mills and the stabilizer each include: a tubular housing having a bore therethrough and a plurality of pockets formed in a wall thereof; an arm disposed in each pocket and movable between an extended position and a retracted position; and a hydraulic actuator for extending the arms. An outer diameter of each housing corresponds to a drift diameter of an inner casing string. The mills further comprise cutters disposed along an outer blade portion of each arm. A sweep of the extended blade portions corresponds to a coupling diameter of an outer casing string. The stabilizer further comprises a pad disposed along an outer surface of each arm. A sweep of the extended pads corresponds to a drift diameter of the outer casing string. The mills and the stabilizer are connected together. The stabilizer is located below the mills.

In another embodiment, a method of abandoning a wellbore includes deploying a bottomhole assembly (BHA) into the wellbore through an inner casing string the BHA. The BHA includes a window mill, a section mill, and a stabilizer located below the mills. The method further includes: extending arms of the stabilizer through a window or milled section of the inner casing string and into engagement with an inner surface of an outer casing string; extending arms of the window mill through the window or milled section and radially cutting through the outer casing string, thereby forming an outer window through the outer casing string; longitudinally advancing the BHA while longitudinally milling the outer casing string using the window mill, thereby opening the outer window; extending arms of the section mill through the outer window and longitudinally milling a section of the outer casing string; and retrieving the BHA from the wellbore through the inner casing string.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIGS. 4D-4G illustrate an actuator of the RCW mill.

FIGS. 6A and 6B illustrate a section mill of the first BHA. FIG. 6C illustrates arms of the section mill.

DETAILED DESCRIPTION

Figure 1A:
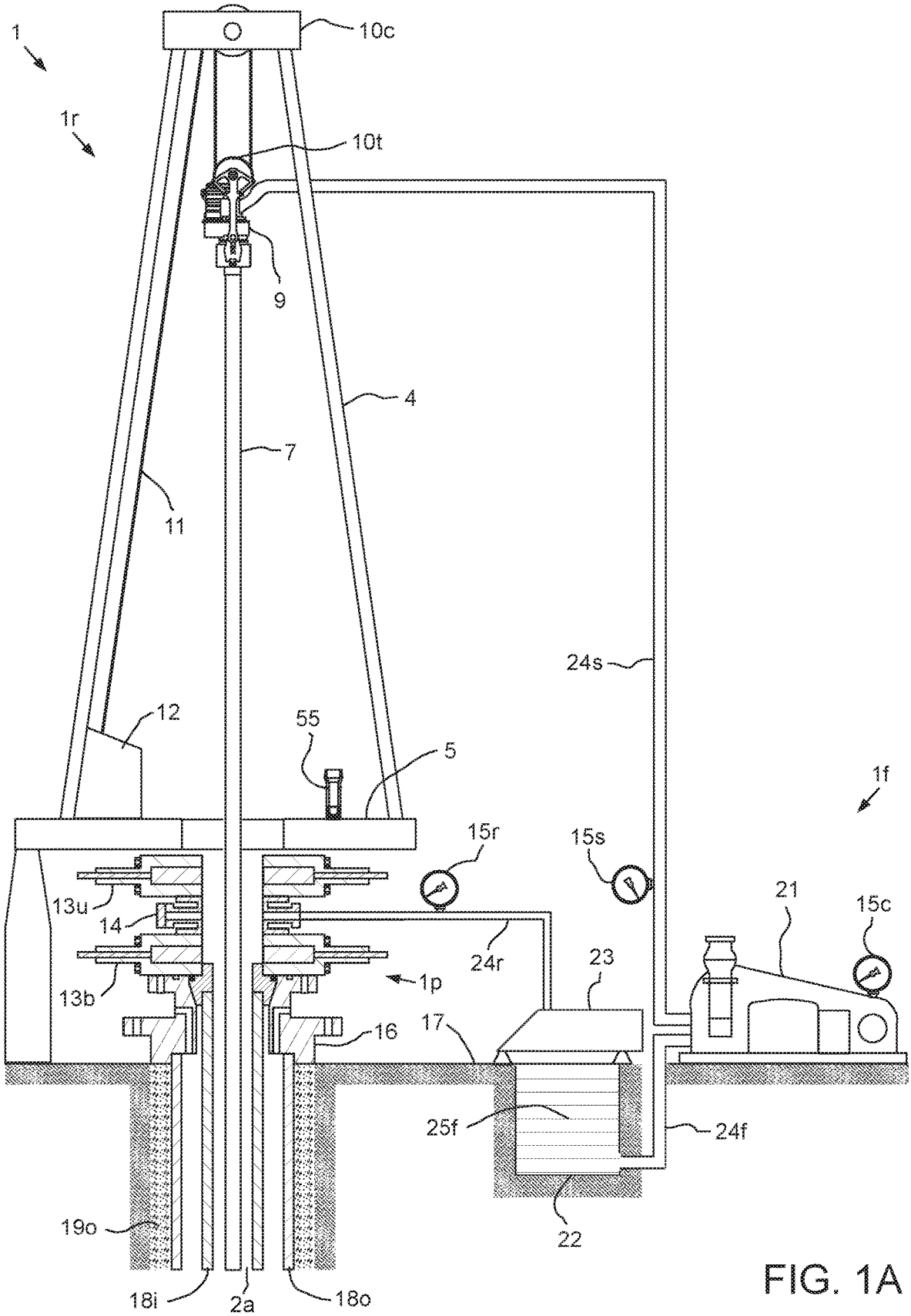
FIGS. 1A-1C illustrates a milling system for abandoning a wellbore, according to one embodiment of the present disclosure.
Figure 1B:
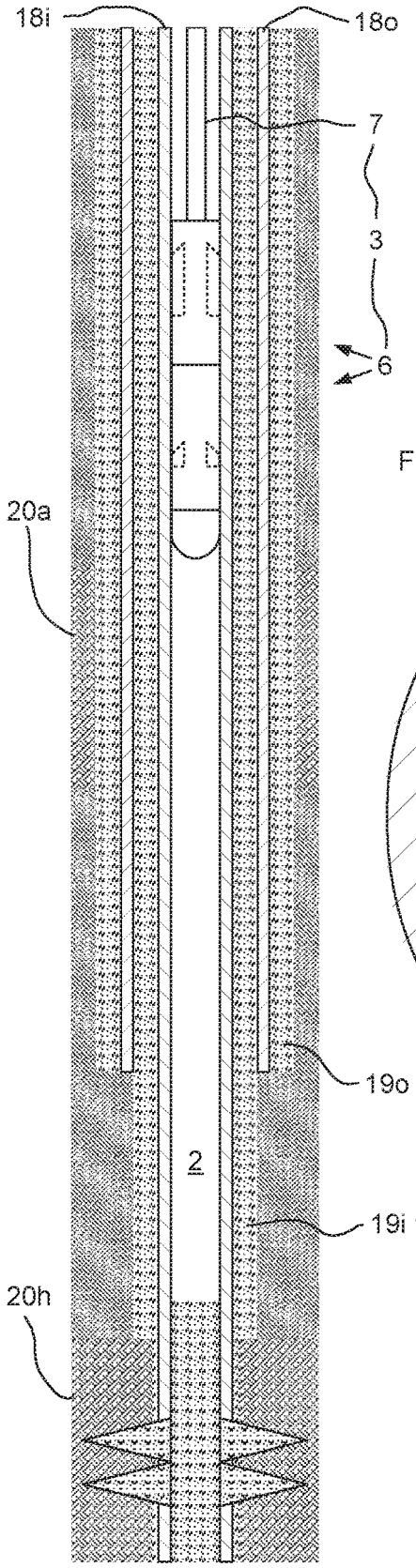
Figure 1C:
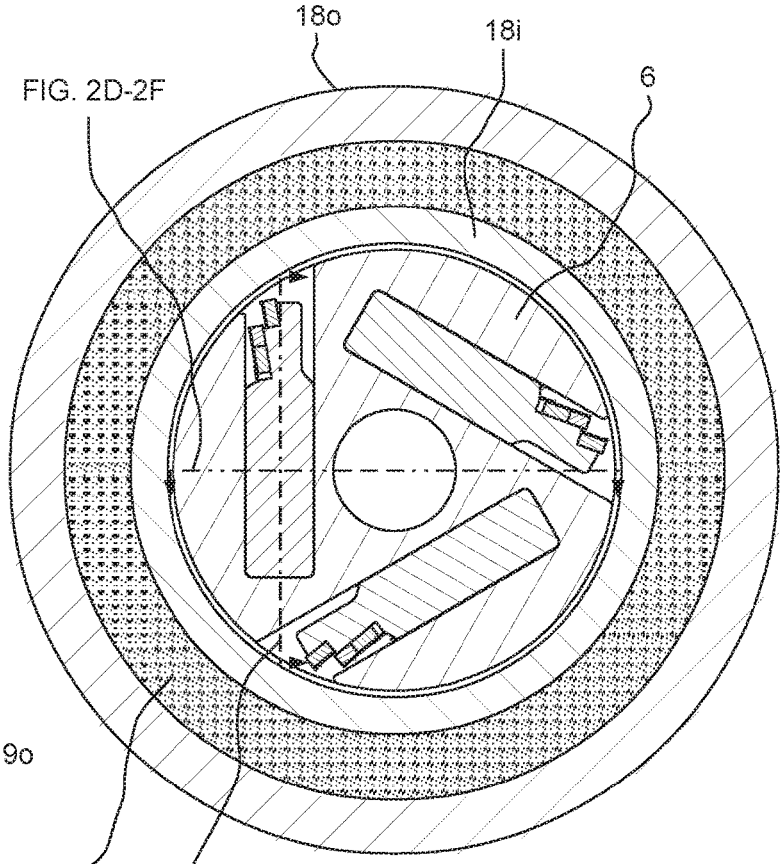
Figure 2A:
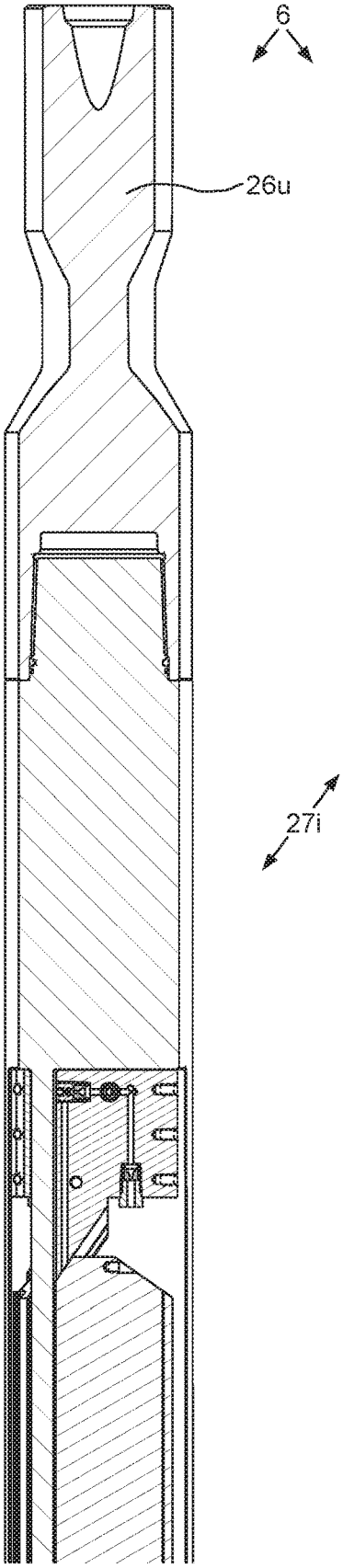
FIGS. 2A-2F illustrate a first bottomhole assembly (BHA) of the milling system.
Figure 2B:
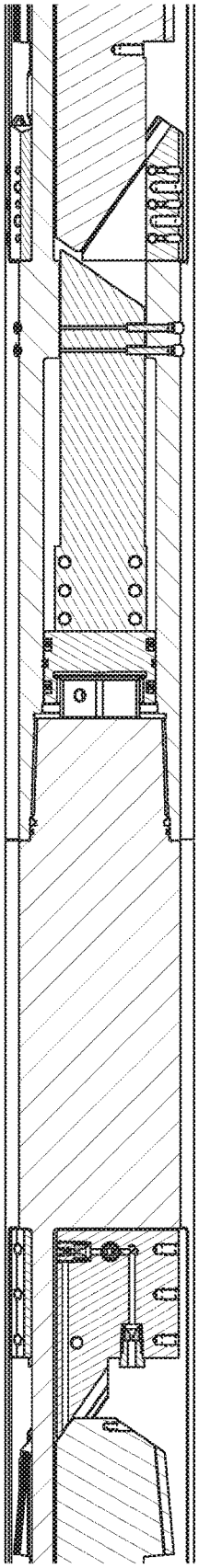
Figure 2C:
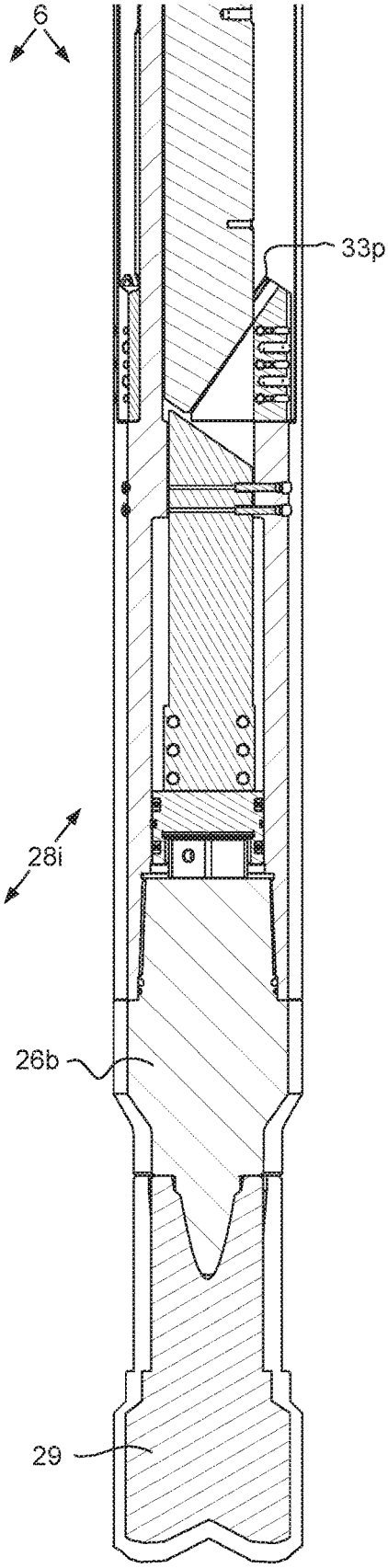
Figure 2D:
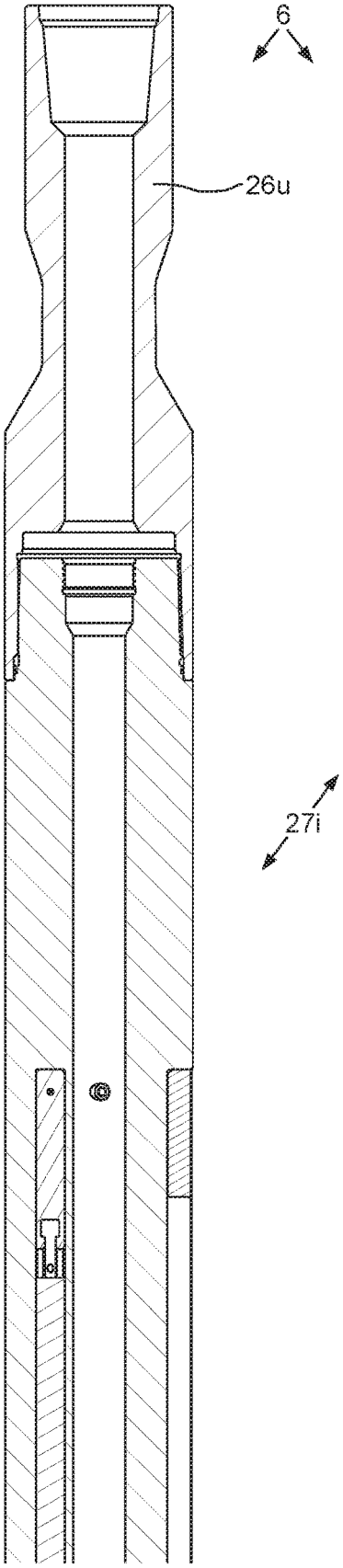
Figure 2E:
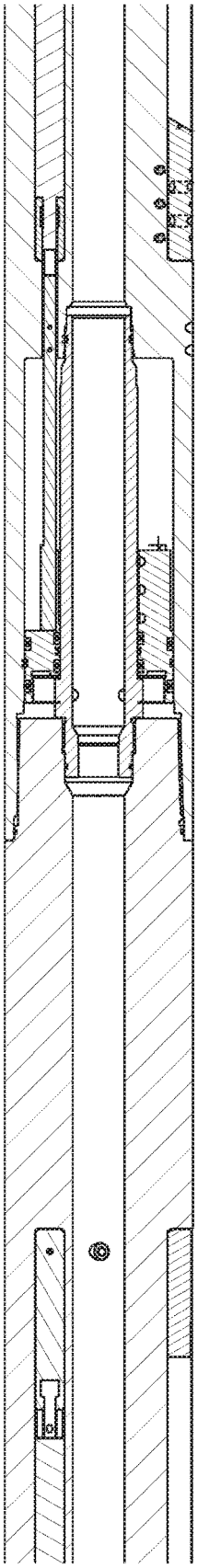
Figure 2F:
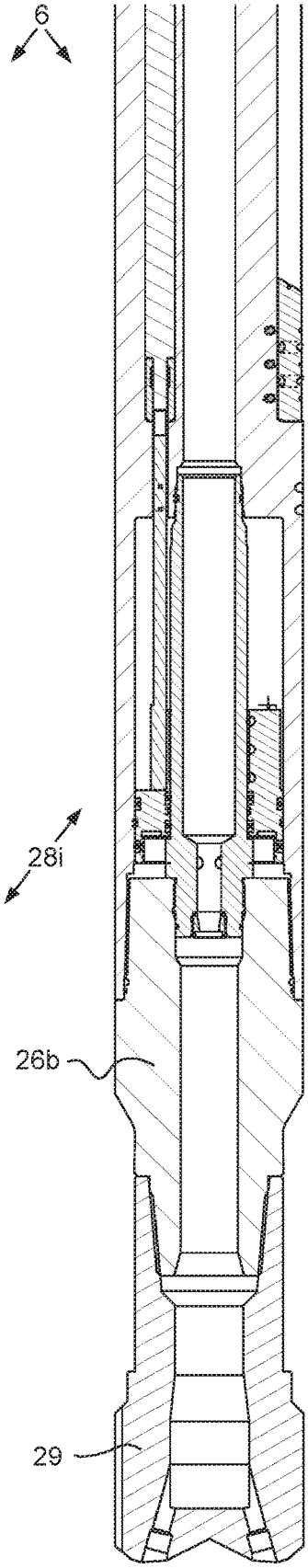
Figure 5A:
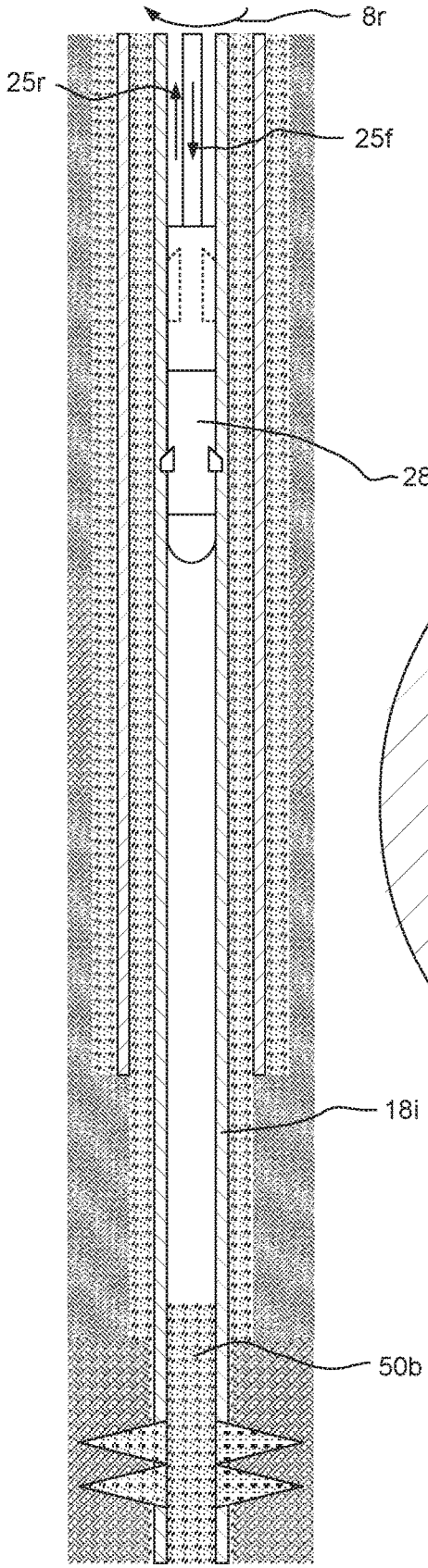
FIGS. 5A-5D illustrate operation of the RCW mill.
Figure 5B:
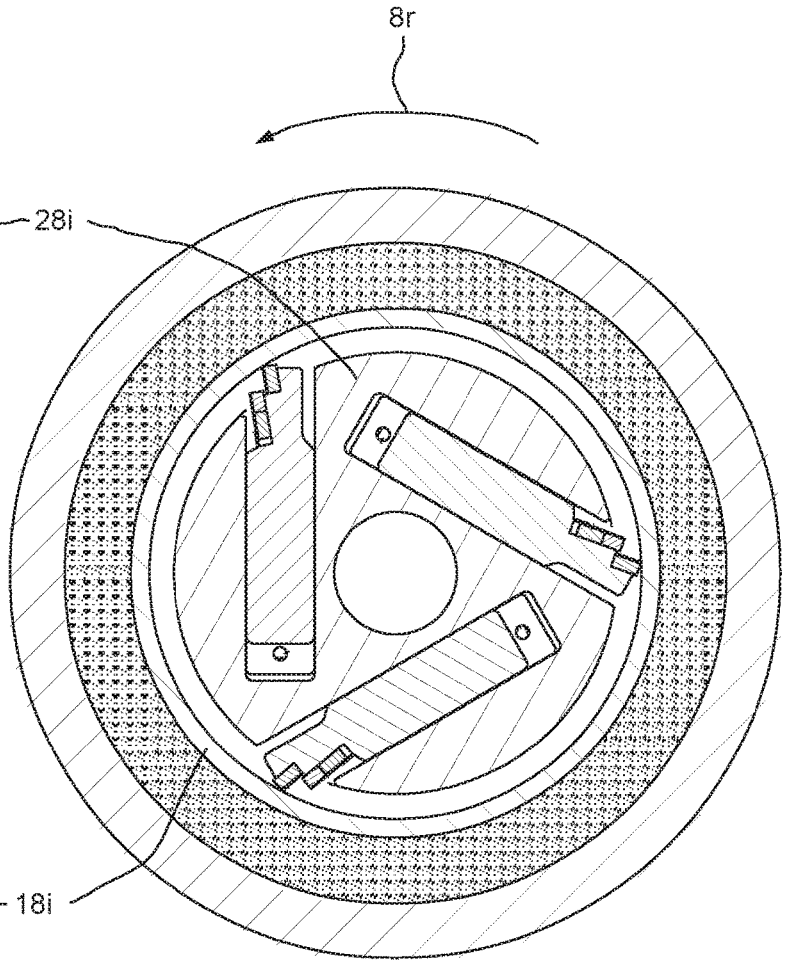

FIGS. 1A-1C illustrates a milling system 1 for abandoning a wellbore 2, according to one embodiment of the present disclosure. The milling system 1 may include a drilling rig 1*r*, a fluid handling system 1*f*, a pressure control assembly (PCA) 1*p*, and a mill string 3. The drilling rig 1*r* may include a derrick 4 having a rig floor 5 at its lower end. The rig floor 5 may have an opening through which the mill string 3 extends downwardly into the PCA 1*p*. The mill string 3 may include a bottomhole assembly (BHA) 6 and a conveyor string 7. The conveyor string 7 may include joints of drill pipe connected together, such as by threaded couplings. The BHA 6 may be connected to the conveyor string 7, such as by threaded couplings. The BHA 6 may be rotated 8*r* (FIG. 5A) by a top drive 9 via the conveyor string 7

Figure 5C:
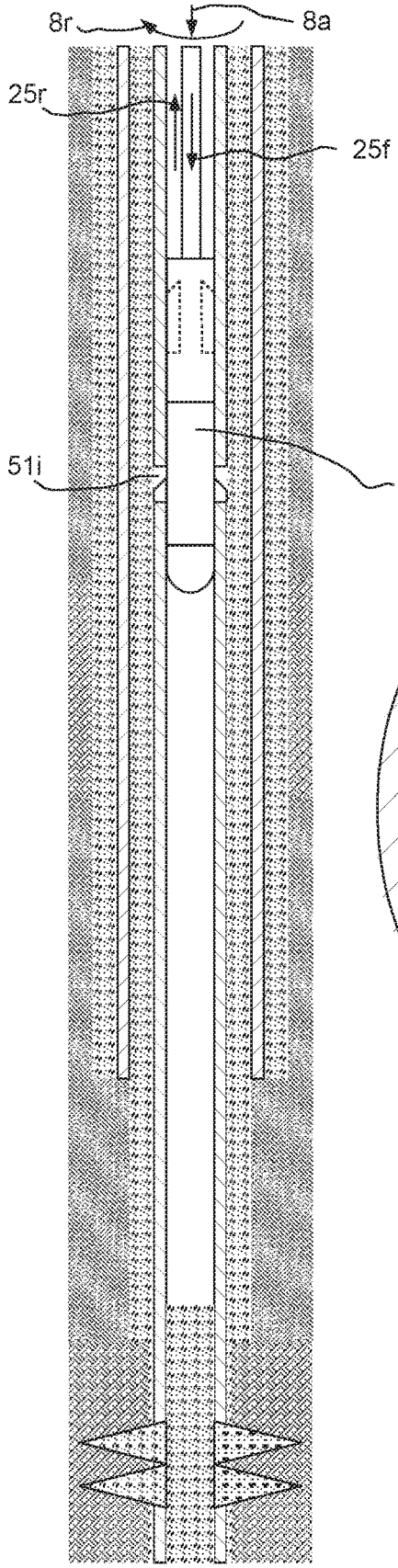
Figure 5D:
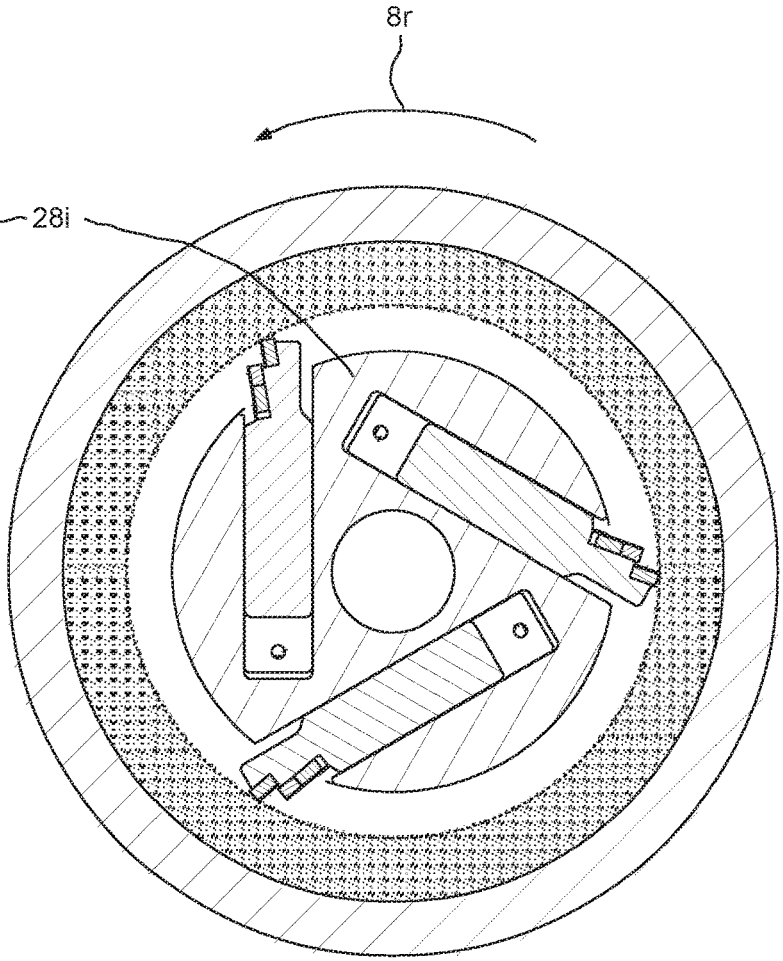

An upper end of the conveyor string 7 may be connected to a quill of the top drive 9. The top drive 9 may include a motor for rotating 8*r* the quill. The top drive motor may be electric or hydraulic. A frame of the top drive 9 may be coupled to a rail (not shown) of the derrick 4 for preventing rotation thereof during rotation 8*r* of the mill string 3 and allowing for vertical movement of the top drive with a traveling block 10*t*. The frame of the top drive 9 may be suspended from the derrick 4 by the traveling block 10*t*. The traveling block 10*t* may be supported by wire rope 11 connected at its upper end to a crown block 10*c*. The wire rope 11 may be woven through sheaves of the blocks 10*t,c* and extend to drawworks 12 for reeling thereof, thereby raising or lowering 8*a* (FIG. 5C) the traveling block 10*t* relative to the derrick 4.

The PCA 1*p* may include, one or more blow out preventers (BOPs) 13*u,b*, a flow cross 14, and one or more pressure gauges 15*r,s*. A housing of each BOP 13*u,b* and the flow cross 14 may each be interconnected and/or connected to a wellhead 16, such as by a flanged connection. The wellhead 16 may be located adjacent to a surface 17 of the earth. The wellhead 16 may be mounted on an outer casing string 18*o* which has been deployed into the wellbore 2 and cemented 19*o* into the wellbore. An inner casing string 18*i* has been deployed into the wellbore 2, hung from the wellhead 16, and cemented 19*i* into place. Each casing string 18*i,o* may include a plurality of casing joints connected together, such as by threaded couplings. The outer casing string 18*o* may isolate an upper formation, such as aquifer 20*a*, from drilling and production. The inner casing string 19*i* may extend to a lower formation, such as hydrocarbon bearing formation 20*h*, and have been perforated for production therefrom.

The fluid system 1*f* may include a mud pump 21, a milling fluid reservoir, such as a pit 22 or tank, a solids separator, such as a shale shaker 23, and one or more flow lines, such as a return line 24*r*, a feed line 24*f*, and a supply line 24*s*. A first end of the return line 24*r* may be connected to a branch of the flow cross 14 and a second end of the return line may be connected to an inlet of the shaker 23. The returns pressure gauge 15*r* may be assembled as part of the return line 24*r* for monitoring wellhead pressure. A lower end of the supply line 24*s* may be connected to an outlet of the mud pump 21 and an upper end of the supply line may be connected to an inlet of the top drive 9. The supply pressure gauge 15*s* may be assembled as part of the supply line 24*s* for monitoring standpipe pressure. A lower end of the feed line 24*f* may be connected to an outlet of the pit 25 and an upper end of the feed line may be connected to an inlet of the mud pump 21. The mud pump 21 may have a stroke counter 15*c* for monitoring a flow rate thereof. The milling fluid 25*f* may include a base liquid. The base liquid may be refined or synthetic oil, water, brine, or a water/oil emulsion. The milling fluid 25*f* may further include solids dissolved or suspended in the base liquid, such as organophilic clay, lignite, and/or asphalt, thereby forming a mud.

Alternatively, a workover rig may be used instead of a drilling rig. Alternatively, the upper formation may instead be hydrocarbon bearing and may have been previously produced to depletion or ignored due to lack of adequate capacity. Alternatively, the wellbore 2 may be subsea having the wellhead 16 located adjacent to the waterline and the drilling rig 1*r* may be a located on a platform adjacent to the wellhead. Alternatively, the wellbore 2 may be subsea having the wellhead 16 located adjacent to the seafloor, the drilling rig 1*r* may be located onboard an offshore drilling unit or intervention vessel, and the milling system 1 may further include a marine riser connecting the fluid handling system 1*f* to the wellhead or the PCA 1*p* may further include a rotating control device and a subsea return line connecting the fluid handling system 1*f* to the wellhead. Alternatively, a Kelly and rotary table (not shown) may be used instead of the top drive 9. Alternatively, the mill string 3 may further include a drilling motor (not shown) for rotating 8*r* the BHA 6 independently or in conjunction with the top drive 9. Alternatively, the conveyor string 7 may be coiled tubing instead of drill pipe and the mill string 3 may include the drilling motor for rotating 8*r* the BHA 6.

FIGS. 2A-2F illustrate the BHA 6. The BHA 6 may include an upper adapter 26*u*, a section mill 27*i*, a radial cutout and window (RCW) mill 28*i*, a lower adapter 26*b*, and a shoe, such as a drill bit 29. The upper adapter 26*u* may have a threaded coupling formed at each longitudinal end thereof for connection to a bottom of the conveyor string 7 at an upper end thereof and for connection to an upper end of the section mill 27*i* at a lower end thereof. The lower adapter 26*b* may have a threaded coupling formed at each longitudinal end thereof for connection to the RCW mill 28*i* at an upper end thereof and for connection to the drill bit 29 at a lower end thereof.

Alternatively, the BHA 6 may further include a second (or more) section mill 28*i*. Alternatively, the BHA 6 may further include a disconnect sub connected between the upper adapter 26*u* and the conveyor string 7. Alternatively, the mills 27*i*, 28*i* may be transposed in the BHA 6. Alternatively, the shoe may be a guide shoe or reamer shoe instead of the drill bit 29.

Figures 3A, 3B, 4A:
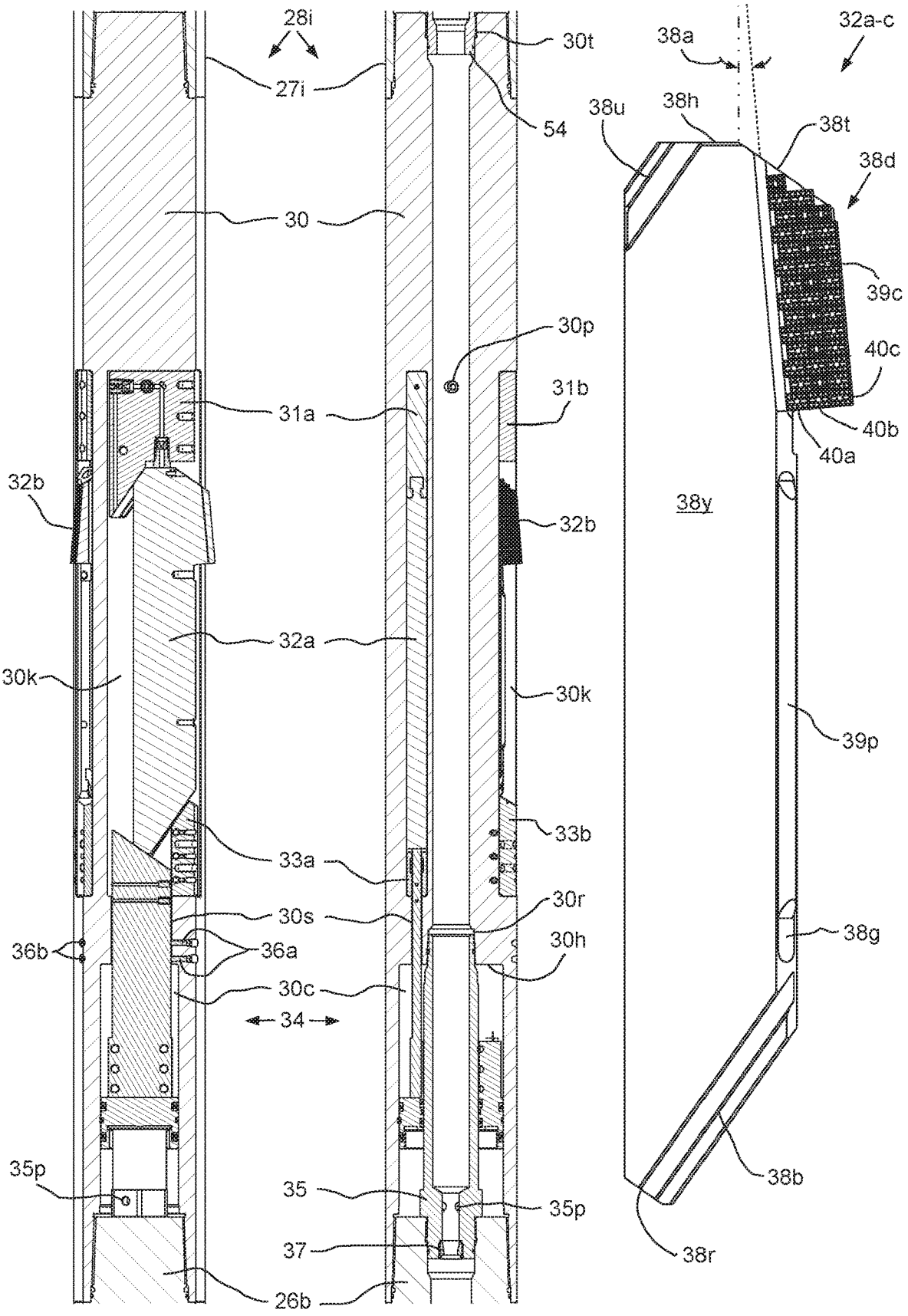
FIGS. 3A and 3B illustrate a radial cutout and window (RCW) mill of the first BHA.
FIG. 4A illustrates arms of the RCW mill.

FIGS. 3A and 3B illustrate the RCW mill 28*i*. The RCW mill 28*i* may include a housing 30, one or more upper blocks 31*a-c* (31*c* in FIG. 4B), one or more arms 32*a-c* (32*c* in FIG. 4A), one or more lower blocks 33*a,b* (third lower block not shown), an actuator 34, and a mandrel 35.

The housing 30 may be tubular, have a bore formed therethrough, and have threaded couplings formed at longitudinal ends thereof for connection to the section mill 27*i* at an upper end thereof and connection to the lower adapter 26*b* at a lower end thereof. The housing 30 may have a pocket 30*k* formed in a wall thereof for each arm 32*a-c* and a port 30*p* formed through the wall thereof for each pocket. Each port 30*p* may extend from the bore to an outer surface of the housing 30 and intersect each pocket 30*k*, thereby providing fluid communication between the housing bore and the respective pocket. The housing 30 may also have a shoulder 30*h* formed in an inner surface thereof. A chamber 30*c* may be formed radially between the housing 30 and the mandrel 35 and longitudinally between the housing shoulder 30*h* and a top of the upper adapter 26*b*. An outer surface of the mandrel 35 and an inner surface of the housing 30 adjacent to the chamber may be seal receptacles for interaction with the actuator 34. A nominal outer diameter of the housing 30 may be equal to or slightly less than a drift diameter of the inner casing 18*i*.

The housing 30 may have a threaded socket 30*t* formed in an inner surface thereof at the upper end thereof for receiving a mandrel 54 of the section mill 27*i*. The housing 30 may also have a seal receptacle 30*r* formed in an inner surface thereof adjacent to the shoulder 30*h* for receiving an upper end of the mandrel 35. The lower adapter 26*b* may have a threaded socket formed in an inner surface thereof for receiving a lower end of the mandrel 35. The mandrel 35 may carry a seal at each longitudinal end thereof for isolating an interface between the mandrel and the housing 30 and between the mandrel and the lower adapter 26*b*. The mandrel 35 may have a threaded coupling formed at a lower end thereof for connection to the lower adapter 26*b*. The mandrel 35 may have one or more ports 35*p* formed through a wall thereof for providing fluid communication between a bore of the RCW mill 28*i* (formed by the housing bore and mandrel bore) and the actuator 34. The mandrel 35 may have a threaded socket formed in an inner surface thereof at a lower end thereof (below the ports 35*p*) for receiving a nozzle 37. The nozzle 37 may be made from an erosion resistant material and restrict flow of the milling fluid 25*f* therethrough to create a pressure differential between the mill bore and an annulus 2*a* formed between the mill string 3 and the inner casing 18*i* for operation of the actuator 34.

Each arm 32*a-c* may be movable relative to the housing 30 between a retracted position (FIGS. 2B, 2C, 2E, and 2F) and an extended position (FIGS. 3A and 3B). Each arm 32*a-c* may be disposed in the respective pocket 30*k* in the retracted position and at least a portion of each arm may extend outward from the respective pocket in the extended position. Each pocket 30*k* may be eccentrically arranged relative to the housing 30 and each arm 32*a-c* may have an eccentric extension path relative to the housing resulting in a far-reaching available blade sweep.

Figure 4B:
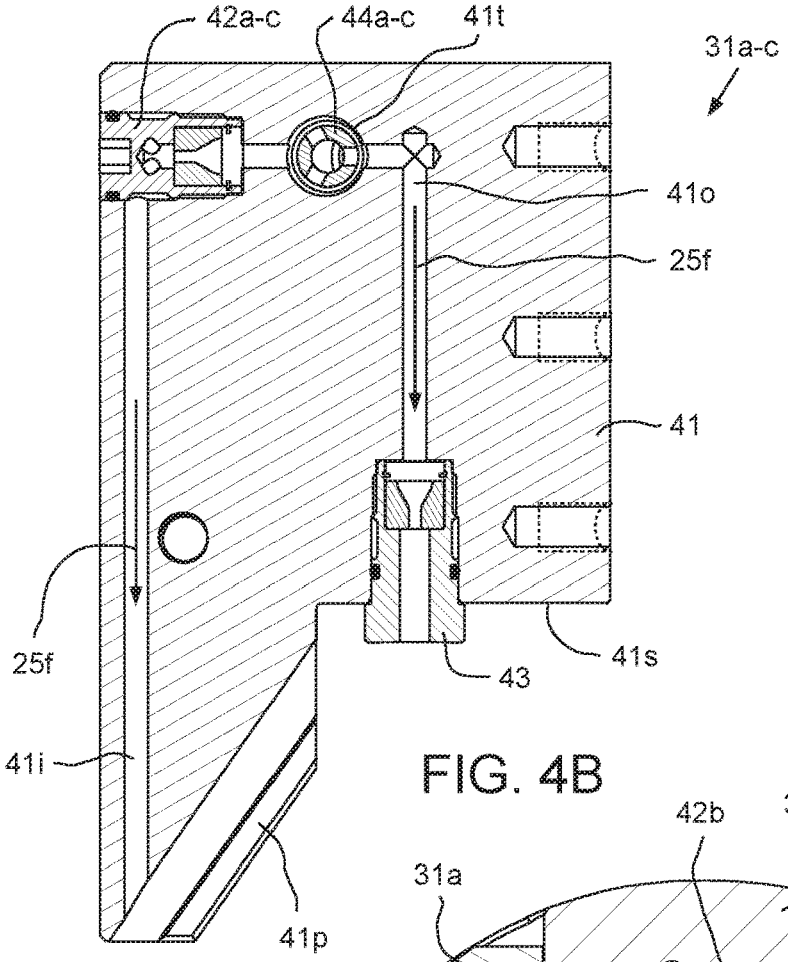
FIGS. 4B and 4C illustrate upper blocks of the RCW mill.
Figure 4C:
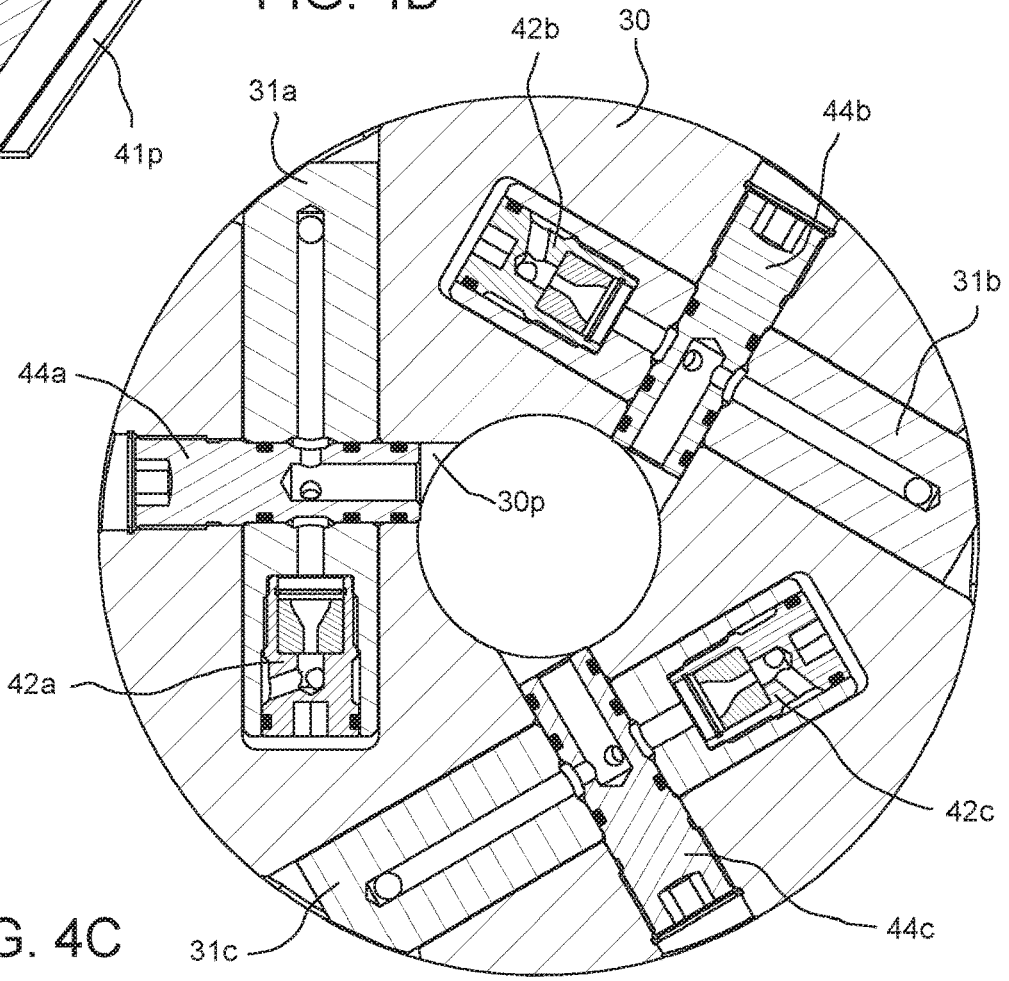
Figures 4D, 4E:
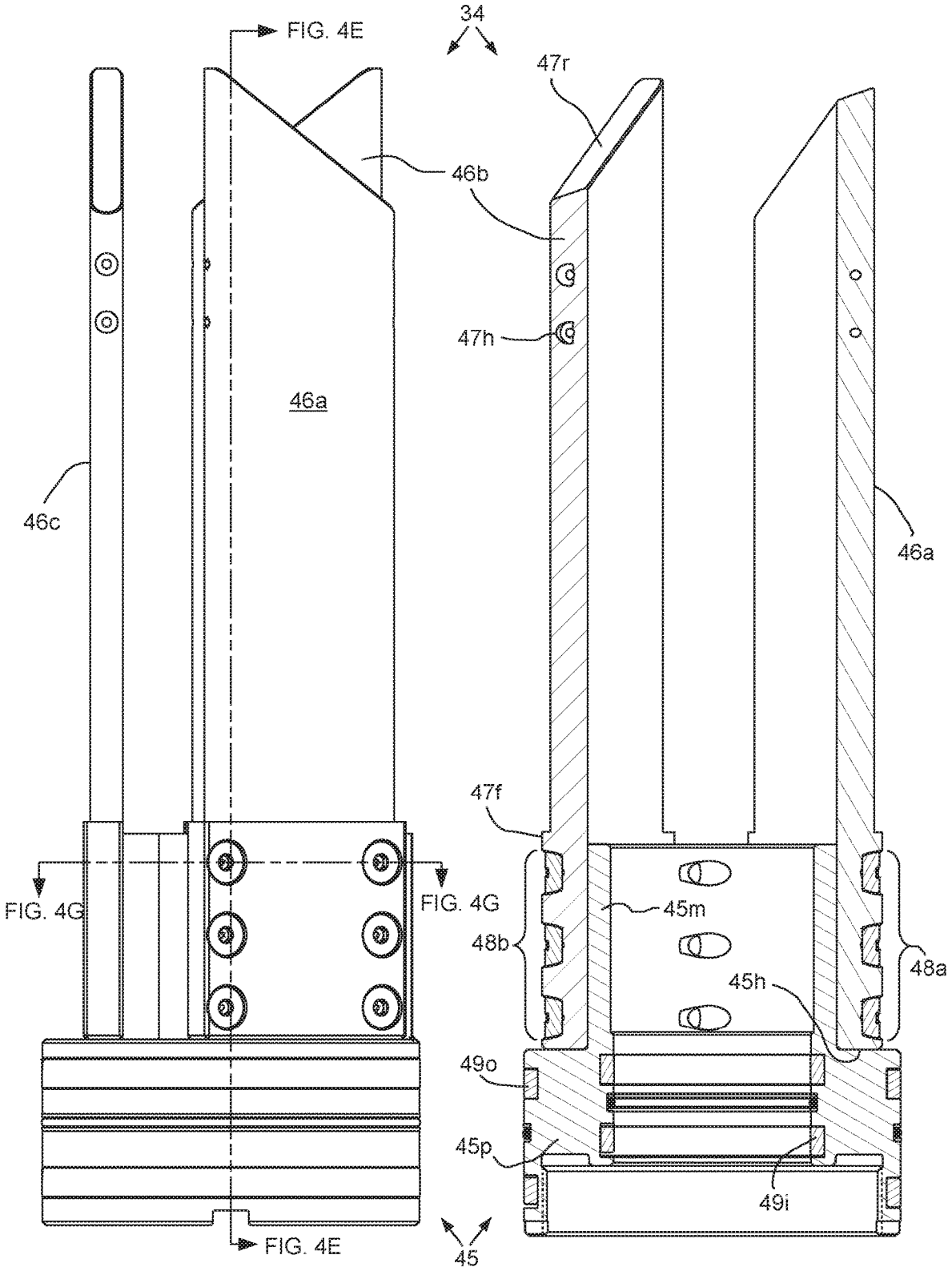

FIG. 4A illustrates the arms 32*a-c*. FIGS. 4B and 4C illustrate the upper blocks 31*a-c*. Each upper block 31*a-c* may be disposed in a respective pocket 30*k* and connected to the body 30, such as by one or more fasteners. Each upper block 31*a-c* may include a body 41, a respective nozzle 42*a-c*, and a stop 43. Each lower block 33*a-c* may be disposed in a respective pocket 30*k* and connected to the body 30, such as by one or fasteners.

Each arm 32*a-c* may have an inner body portion 38*y* and an outer blade portion 38*d*. Each body portion 38*y* may have an upper guide 38*u*, such as an inclined T-shaped tongue, formed in an inner portion of an upper end thereof and the respective upper block body 41 may have a mating guide 41*p*, such as an inclined T-slot, formed in an inner portion of a lower end thereof. Each body portion 38*y* may also have a lower guide 38*b*, such as an inclined tongue, formed in a mid and an outer portion of a lower end thereof and the respective lower block 33*a-c* may have a mating guide, such as an inclined T-slot 33*p* (FIG. 2C), formed in a mid and inner portion of an upper end thereof. Each body portion 38*y* may have a lower cam, such as a ramp 38*r*, formed in an inner portion of a lower end thereof for interaction with the actuator 34. Inclinations of the guides 33*p*, 38*u,b*, 41*p* may be corresponding and the cam inclination may be opposed to the guide inclinations.

The arms 32*a-c* may slide along the guides 33*p*, 38*u,b*, 41*p* to move radially outward as the arms are pushed longitudinally upward by the actuator 34. The guides 33*p*, 38*u,b*, 41*p* may also serve to mechanically lock the arms 32*a-c* in the extended position during longitudinal milling as longitudinal reaction force from the inner casing 18*i* pushes each blade portion 38*d* against the respective upper block 31*a-c*, thereby reducing or eliminating any chattering of the blade portions due to pressure fluctuations in the milling fluid 25*f*.

Each blade portion 38*d* may have one or more rows 40*a-c* of sockets extending along a forward face thereof. The rows 40*a-c* may be adjacent to each other. A cutter 39*c* may be disposed into each socket. Each cutter 39*c* may be made from a material suitable for cutting the casing material (i.e. steel), such as ceramic or cermet (i.e., tungsten carbide). The cutters 39*c* may be pressed or threaded into the sockets and the rows 40*a-c* fixed into place, such as by welding. The inner and intermediate rows 40*a,b* may form a lead cutting surface for the inner casing joint and the outer row 40*c* may be slightly offset tangentially to form a trail cutting surface for the inner casing coupling.

Alternatively, the cutters 39 may be crushed ceramic or cermet dressed onto the rows 39*a-c* by hardfacing.

Each upper block body 41 may have a shoulder 41*s* formed in an outer portion of the lower end thereof adjacent to the guide 41*p*. Each stop 43 may be fastened to the respective upper block body 41 at the shoulder 41*s*. A mid portion of the upper end of each body portion 38*y* may serve as a stop shoulder 38*h* and extension of the blades 32*a-c* may be complete when the stop shoulders engage the respective stops 43.

An outer portion of each body portion upper end and an upper end of each blade portion 38*d* may be inclined for serving as a retraction profile 38*t*. The retraction profile 38*t* may engage the inner casing string 18*i* (upper surface of an inner window 51*i* (FIG. 5C)) for partially or fully retracting the arms 32*a-c* once milling of the inner casing string is complete. The retraction inclination may correspond to the cam inclination.

The blade portion 38*d* may have a length substantially shorter than a length of the body portion 38*y*, such as less than or equal to one-half thereof. An outer surface of each blade portion 38*d* may also taper 38*a* slightly outwardly from a top of the RCW mill 28*i* to a bottom of the mill. The taper 38*a* may be between one and ten degrees or between three and seven degrees, such as five degrees. The short blade portion 38*d* may provide increased cutting pressure when starting the inner window 51*i* through the inner casing 18*i*, thereby reducing or eliminating any bearing effect. The taper 38*a* may ensure that a bottom of the blade portion 38*d* engages the inner casing 18*i* before the rest of the blade portion, thereby further increasing cutting pressure. The short blade portion 38*d* may also provide a relatively short cutting lifespan to form a relatively short inner window 51*i*. The cutting lifespan may be less than or equal to the length of a joint of the casing (typically forty feet), such as one-third, one-half, two thirds, or three-quarters the joint length and be greater than or equal to the length of the section mill blade portions 52*a-c* (FIG. 6C). When extended, a sweep of the RCW mill 28*i* may be equal to or slightly greater than a coupling diameter of the inner casing 18*i* and the RCW mill may be capable of cutting the inner window through the inner casing joint or coupling.

Each body portion 38*y* may have a groove 38*g* formed along an exposed portion (not having the blade portion 38*d*) of an outer surface thereof. A pad 39*p* may be pressed into each groove 38*g* and fixed into place, such as by welding. Each pad 39*p* may be made from a material harder than the casing material, such as tool steel, ceramic, or cermet. A sweep of the pads 39*p* may be slightly greater than the drift diameter of the inner casing 18*i* for engaging the inner surface thereof after the blade portions 38*d* have cut through the inner casing. Engagement of the pads 39*p* with the inner casing 18*i* may stabilize the RCW mill 28*i* and prevent damage to the outer casing 18*o*. Once the blade portions 38*d* have worn off, the pads 39*p* may continue to serve as a stabilizer for the section mill 27*i*. The worn blade portions may also serve as a scraper.

Alternatively, each groove 38*g* and/or the pad 39*p* may extend along only a portion of the body portion outer surface. Alternatively, each pad 39*p* may be the exposed outer surface of the body portion 38*y* instead of an insert and the exposed outer surface may be surface hardened or coated.

Each upper block body 41 may have one or more passages 41*i,o* formed therein and a port 41*t* formed therethrough. Each passage 41*i,o* may intersect the port 41*t*. The inner passage 41*i* may extend from the port 41*t* to the guide 41*p* for pressurizing the pocket 30*k* with milling fluid 25*f* from the housing bore to discourage infiltration of cuttings. The outer passage 41*o* may extend from the port 41*t* to the stop 43. Each body 41 may also have an inner threaded socket formed at a bend of the inner passage 41*i* for receiving the respective nozzle 42*a-c* and a second threaded socket formed at the respective shoulder 41*s* for receiving the respective stop 43. Each nozzle 42*a-c* may include a threaded plug and a jet fastened thereto. Each threaded plug may have a bore formed therein and one or more crossover ports in fluid communication with the bore and may carry a seal to isolate an interface between the respective nozzle 42*a-c* and the housing 30. Due to a pressure drop across the nozzles 42*a-c*, the respective pocket 30*k* may be maintained at an intermediate pressure greater than pressure in the annulus 2*a* and less than pressure in the mill bore.

Each stop 43 may include a threaded plug and a jet fastened thereto. Each threaded plug may have a bore formed therethrough and may carry a seal to isolate an interface between the respective stop 43 and the housing 30. Engagement of each stop shoulder 38*h* with the respective stop 43 may close the respective outer passage 41*o*, thereby causing an increase in standpipe pressure detectable by monitoring the supply pressure gauge 15*s* and confirming extension of the arms 32*a-c*.

The RCW mill 28*i* may further include a flow diverter 44*a-c* for each housing port 30*p*. Each housing port 30*p* may be a threaded socket for receiving a respective diverter 44*a-c* and each upper block port 41*t* may be a seal receptacle for receiving the diverter. Each diverter 44*a-c* may include a threaded plug having a bore formed therein and one or more crossover ports in fluid communication with the bore. Each diverter plug may carry a pair of seals straddling the crossover ports to isolate an interface between the respective diverter 44*a-c* and the upper block 31*a-c* and a seal to isolate an interface between the respective diverter and the housing 30.

FIGS. 4D-4G illustrate the actuator 34. The actuator 34 may be hydraulic and longitudinally movable relative to the housing 30 between an upper position (FIGS. 3A and 3B) and a lower position (FIGS. 2B, 2C, 2E, and 2F). The actuator 34 may include a body 45 and a pusher 46*a-c* for each arm 32*a-c*.

The body 45 may be disposed in the chamber 30*c*. The body 45 may have a lower piston portion 45*p*, an upper mount portion 45*m*, and a shoulder 45*h* formed between the two portions. The piston portion 45*p* may carry an outer seal for sealing an interface between the body 45 and the housing 30 and an inner seal for sealing an interface between the body and the mandrel 35. The piston portion 45*p* may also carry one or more (two shown) outer linear bearings 49*o* for facilitating sliding of the body 45 relative to the housing 30 and one or more (two shown) inner linear bearings 49*i* for facilitating sliding of the body 45 relative to the mandrel 35. Each linear bearing 49*i,o* may be a plain bearing made from an abrasion resistant material, such as bronze, graphite alloy composite, Babbitt metal, ceramic, cermet, bi-metal, or lubricant infused alloy composite.

The mount 45*m* may be n-polygonal (n equaling the number of arms 32*a-c*), such as triangular, for receiving the pushers 46*a-c*. Each pusher 46*a-c* may be a rectangular plate. A lower portion 47*f* of each pusher 46*a-c* may be disposed against the shoulder 45*h* and connected to the mount portion 45*m*, such as by a respective set 48*a-c* of one or more (six shown) fasteners. Each pusher 46*a-c* may extend from the mount 45*m* through a respective slot 30*s* formed in the housing wall and bridging the chamber 30*c* and the respective pocket 30*k*. Each lower block 33*a,b* may have slot formed therethrough aligned with the respective housing slot 30*s* and the respective pusher 46*a-c* may also extend through the respective lower block slot into the respective pocket 30*k*. Each pusher 46*a-c* may have a cam, such as a ramp 47*r*, formed in an upper end thereof for mating with the respective ramp 38*r*, thereby extending the respective arm 32*a-c* when the pusher is pressed against the arm by the piston portion 45*p*.

The piston portion 45*p* may divide the chamber 30*c* into an upper portion and a lower portion. The chamber upper portion may be in fluid communication with the pockets 30*k* via leakage through the slots 30*s*. The chamber lower portion may be in fluid communication with the mill bore via the mandrel ports 35*p*. Pressure differential between the mill bore pressure and the intermediate pocket pressure may exert a net upward actuation force on the piston portion 45*p* when the milling fluid 25*f* is pumped down the mill string 3.

The RCW mill 28*i* may initially be restrained in the retracted position by one or more sets 36*a,b* (third set not shown) of one or more (two shown) shearable fasteners, such as pins. The housing 30 may have a socket formed through the wall thereof for receiving an outer portion of each shear pin and each pusher 46*a-c* may have a socket formed in an outer face thereof for receiving an inner portion of each pin of a respective set 36*a,b*. Each housing socket may be threaded for receiving a retention plug to keep the respective shear pin in place. Collectively, the shear pins may fasten the actuator 34 to the housing 30 until the actuation force reaches a shear force necessary to fracture the shear pins and release the actuator from the housing. The actuation force may increase as an injection rate of milling fluid 25*f* through the mill string 3 is increased until the injection rate reaches an activation threshold.

FIGS. 5A-5D illustrate operation of the RCW mill 28*i*. Once hydrocarbon bearing formation 20*h* is depleted, it may be desirable to plug and abandon (P&A) the wellbore 2. To begin the P&A operation, production equipment (not shown), such as a production tubing string and a production tree may be removed from the wellbore 2 and wellhead 16 and a lower cement plug 50*b* set to isolate the hydrocarbon formation 20*h*.

The BHA 6 may be assembled and deployed into the wellbore 2 using the conveyor string 7 through the inner casing 18*i* and to the lower cement plug 50*b*. During deployment of the mill string 3, the milling fluid 25*f* may be circulated by the mud pump 21 at a flow rate less than the activation threshold. The mill string 3 may then be rotated 8*r* and the drill bit 29 may be engaged with a top of the plug 50*b* to verify integrity thereof. Rotation 8*r* may be halted and the BHA 6 may be raised to the aquifer 20*a*. The BHA 6 may be raised so that the RCW mill 28*i* is slightly above a top of the aquifer 20*a* and between couplings of the inner casing 18*i*. Rotation 8*r* of the mill string 3 may resume and injection of the milling fluid 25*f* may be increased to at least the activation threshold, thereby releasing the actuator 34 from the housing 30. The piston portion 45*p* may then move the pushers 46*a-c* upward and the arms 32*a-c* outward until cutters 39*c* of the outer row 40*c* engage the inner surface of the inner casing string 18*i*. During extension of the RCW mill 28*i*, the section mill 27*i* may be restrained from extension.

The blade portions 38*d* may engage the inner casing 18*i* and begin to radially cut through the inner casing wall. The milling fluid 25*f* may be circulated through the mill string 3 and up the annulus 2*a* and a portion of the milling fluid 25*f* may be diverted into the upper blocks 31*a-c*. The BHA 6 may be held longitudinally in place during the radial cut through operation. The supply pressure gauge 15*s* may be monitored to determine when the RCW mill 28*i* has radially cut through the inner casing 18*i* and started the window 51*i* as indicated by an increase in pressure caused by engagement of the arms 32*a-c* with the respective stops 43. Each window 51*i* may extend entirely around and through the inner casing 18*i*. Weight may then be set down on the BHA 6. The RCW mill 28*i* may then longitudinally open the window 51*i* while the pads 39*p* engage the inner surface of the inner casing 18*i*, thereby stabilizing the RCW mill. Longitudinal advancement of the RCW mill 28*i* may continue until the blade portions 38*d* are exhausted. Torque exerted by the top drive 9 may be monitored to determine when the blade portions 38*d* have become exhausted.

FIGS. 6A and 6B illustrate the section mill 27*i*. The section mill 27*i* may include the housing 30, the upper blocks 31*a-c*, one or more arms 52*a-c* (52*c* in FIG. 6C), the lower blocks 33*a,b* (third lower block not shown), the actuator 34, and a mandrel 54.

The mandrel 54 may carry a seal at each longitudinal end thereof for isolating an interface between the mandrel and the housing 30 and between the mandrel and the RCW housing 30. The mandrel 54 may have a threaded coupling formed at a lower end thereof for connection to the RCW housing. The mandrel 54 may have one or more ports 54*p* formed through a wall thereof for providing fluid communication between a bore of the section mill 27*i* (formed by the housing bore and mandrel bore) and the actuator 34. The mandrel 54 may have a receiver 54*r* formed in an inner surface thereof at a lower end thereof (below the ports 54*p*) for receiving a pump down plug, such as a dart 55. The receiver 54*r* may include a landing shoulder and a seal receptacle. The dart 55 may include a body having a threaded socket formed in an inner surface thereof at a lower end thereof for receiving a nozzle. The dart nozzle may be made from an erosion resistant material and restrict flow of the milling fluid 25*f* therethrough to create a pressure differential between the mill bore and the annulus 2*a*. The dart body may carry a seal for sealing an interface between the dart 55 and the mandrel and have a landing shoulder formed in an outer surface thereof for seating against the mandrel landing shoulder.

Each arm 52*a-c* may be movable relative to the housing 30 between a retracted position (FIGS. 2A, 2B, 2D, and 2E) and an extended position (FIGS. 6A and 6B). Each arm 52*a-c* may be disposed in the respective pocket 30*k* in the retracted position and at least a portion of each arm may extend outward from the respective pocket in the extended position. Each pocket 30*k* may be eccentrically arranged relative to the housing 30 and each arm 52*a-c* may have an eccentric extension path relative to the housing resulting in a far-reaching available blade sweep.

FIG. 6C illustrates arms 52*a-c* of the section mill. Each arm 52*a-c* may have an inner body portion 56*y* and an outer blade portion 56*d*. Each body portion 56*y* may have the upper guide 38*u* and the lower guide 38*b* for interaction with the respective blocks 31*a-c*, 33*a,b* and the ramp 38*r* for interaction with the actuator 34. Each blade portion 56*d* may have one or more rows 58*a-c* of sockets extending along a forward face thereof. The rows 58*a-c* may be adjacent to each other. The cutter 39*c* may be disposed into each socket. The inner and intermediate rows 58*a,b* may form a lead cutting surface for the inner casing joint and the outer row 58*c* may be slightly offset tangentially to form a trail cutting surface for the inner casing coupling.

An outer portion of each body portion upper end and an upper end of each blade portion 56*d* may be inclined for serving as a retraction profile 56*t*. The retraction profile 56*t* may engage the inner casing string 18*i* (upper surface of the inner window 51*i*) for partially or fully retracting the arms 52*a-c* once milling of the inner casing string is complete. The retraction inclination may correspond to the cam inclination.

Each blade portion 56*d* may have a length substantially greater than the RCW blade portions 38*d* and corresponding to, such as slightly less than, a length of the body portion 56*y* to ensure a long cutting lifespan. The lifespan may be greater than or equal to a length of one or more casing joints, such as greater than or equal to one hundred feet of casing (including couplings). An outer surface of each blade portion 56*d* may be straight. When extended, a sweep of the section mill 27*i* may be equal to or slightly greater than a coupling diameter of the inner casing 18*i* and the section mill 27*i* may be capable of milling an inner section 59*i* (FIG. 7C) through the inner casing joint or coupling.

Each body portion 56*y* may have a groove 56*g* formed along an exposed portion (not having the blade portion 56*d*) of an outer surface thereof. A pad 57 may be pressed into each groove 56*g* and fixed into place, such as by welding. Each pad 57 may be made from any of the materials for the pad 39*p*. A sweep of the pads 57 may be slightly greater than the drift diameter of the inner casing 18*i* for engaging the inner surface thereof after the blade portions 56*d* have been extended through the inner window 51*i*. Engagement of the pads 57 with the inner casing 18*i* may stabilize the section mill 27*i* and prevent damage to the outer casing 18*o*.

The section mill 27*i* may initially be restrained in the retracted position by one or more sets 53*a,b* (third set not shown) of one or more (two shown) shearable fasteners, such as pins. Collectively, the shear pins may fasten the actuator 34 to the housing 30 until the actuation force reaches a second shear force necessary to fracture the shear pins and release the actuator from the housing. The actuation force may increase as an injection rate of milling fluid 25*f* through the mill string 3 is increased until the injection rate reaches a second activation threshold. The second shear force and second activation threshold may be greater than those of the RCW mill 28*i* such that the section mill 27*i* remains locked in the retracted position during milling of the inner window 51*i*.

Figure 7A:
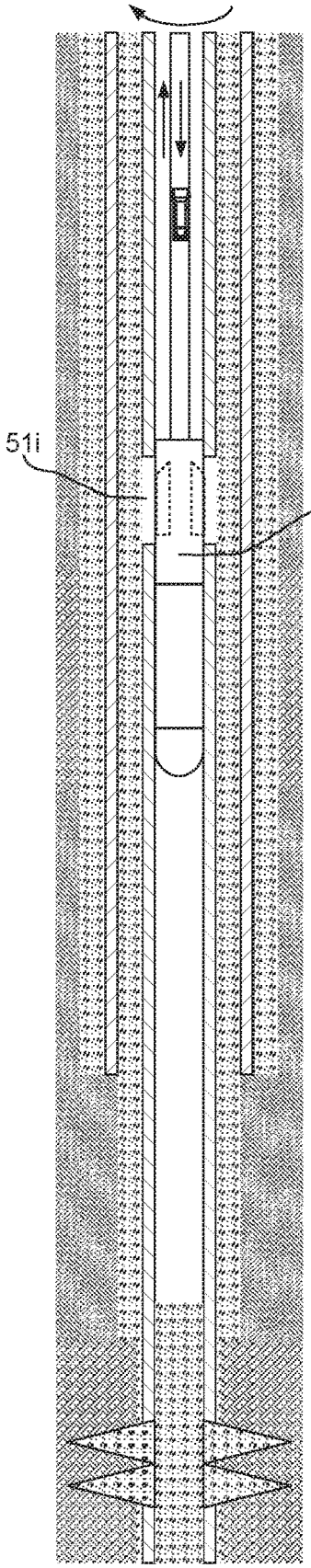
FIGS. 7A-7C illustrate operation of the section mill.
Figure 7B:
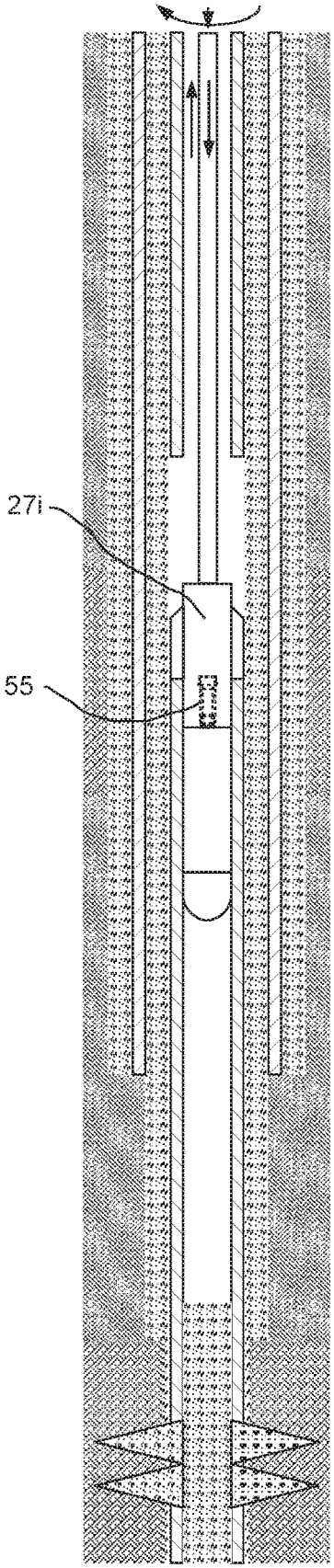
Figure 7C:
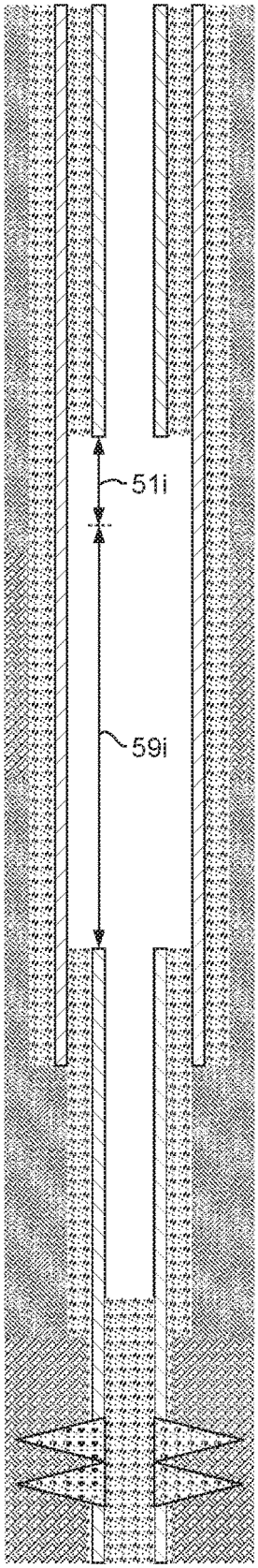
Figure 9A:
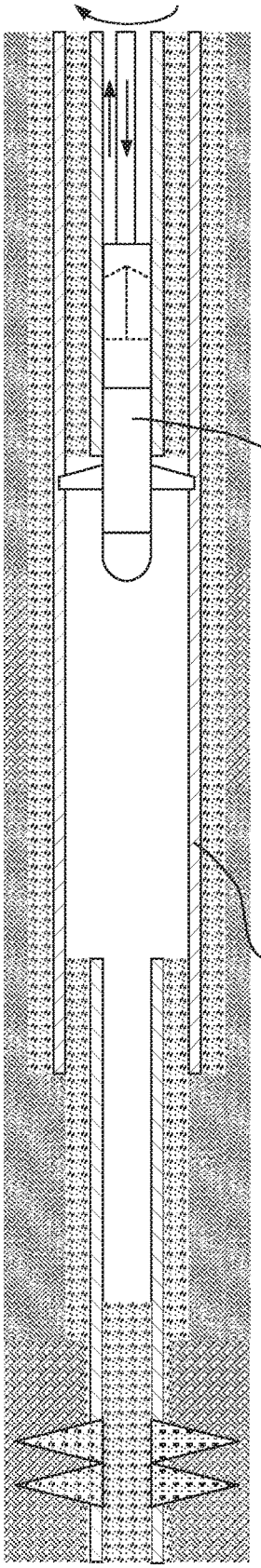
FIGS. 9A-9D illustrate operation of an RCW mill of the second BHA.

FIGS. 7A-7C illustrate operation of the section mill 27*i*. Once the inner window 51*i* has been formed, rotation of the mill string 3 may be halted. The section mill 27*i* may then be aligned with the inner window 51*i* or may already be aligned with the inner window. An upper portion of the conveyor string 7 may be disconnected and the dart 55 inserted into the mill string 3. The conveyor string 7 may then be reconnected and the mud pump 21 operated to pump the dart 55 downward through the conveyor string 7 and into the BHA 6 until the dart engages the receiver 54*r*. An injection rate of the milling fluid 25*f* into the mill string 3 may be increased until the second threshold is reached, thereby releasing the actuator 34.

The blade portions 56*d* may be extended through the inner window 51*i* by the actuator 34. The BHA 6 may be rotated 8*r* and held longitudinally in place during extension of the arms 52*a-c*. The supply pressure gauge 15*s* may be monitored to confirm extension as indicated by an increase in pressure caused by engagement of the arms 52*a-c* with the respective stops 43. Weight may then be set down on the BHA 6. The section mill 27*i* may then be advanced to longitudinally mill the inner section 59*i* while the pads 57 engage the inner surface of the inner casing 18*i*, thereby stabilizing the section mill. Longitudinal advancement of the section mill 27*i* may continue until the inner section 59*i* adjacent to the aquifer 20*a* is complete and may or may not further continue until the blade portions 56*d* are exhausted. The mill string 3 may then be retrieved to the drilling rig 1*r*.

FIGS. 8A-8F illustrate a second BHA 60 of the milling system 1. The second BHA 60 may be similar or identical to the BHA 6 except for the substitution of an outer section mill 27*o* and outer RCW mill 28*o* for the respective inner section mill 27*i* and inner RCW mill 28*i*.

Figures 8A, 8B, 8C:
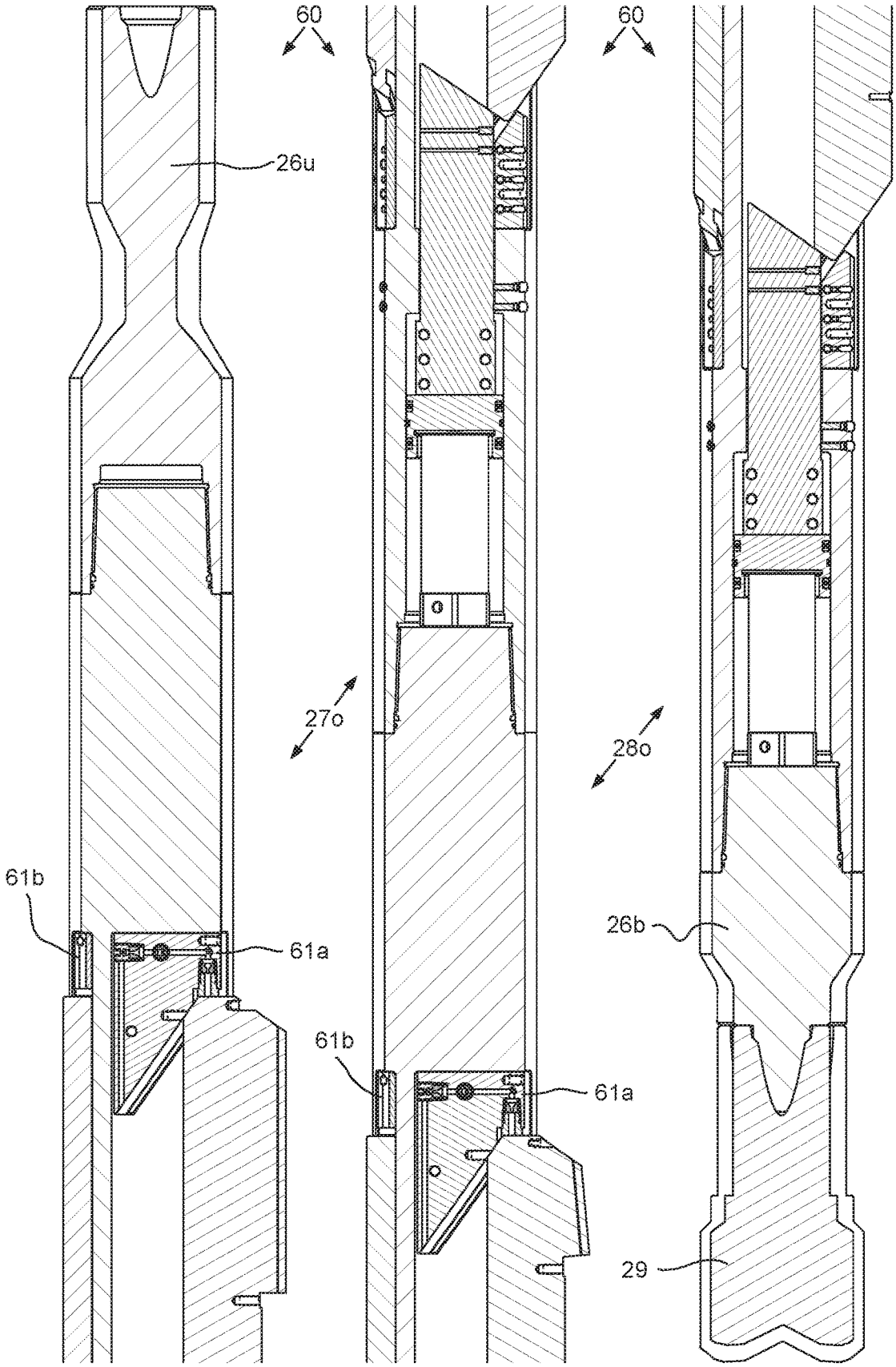
FIGS. 8A-8F illustrate a second BHA of the milling system.
Figures 8D, 8E, 8F:
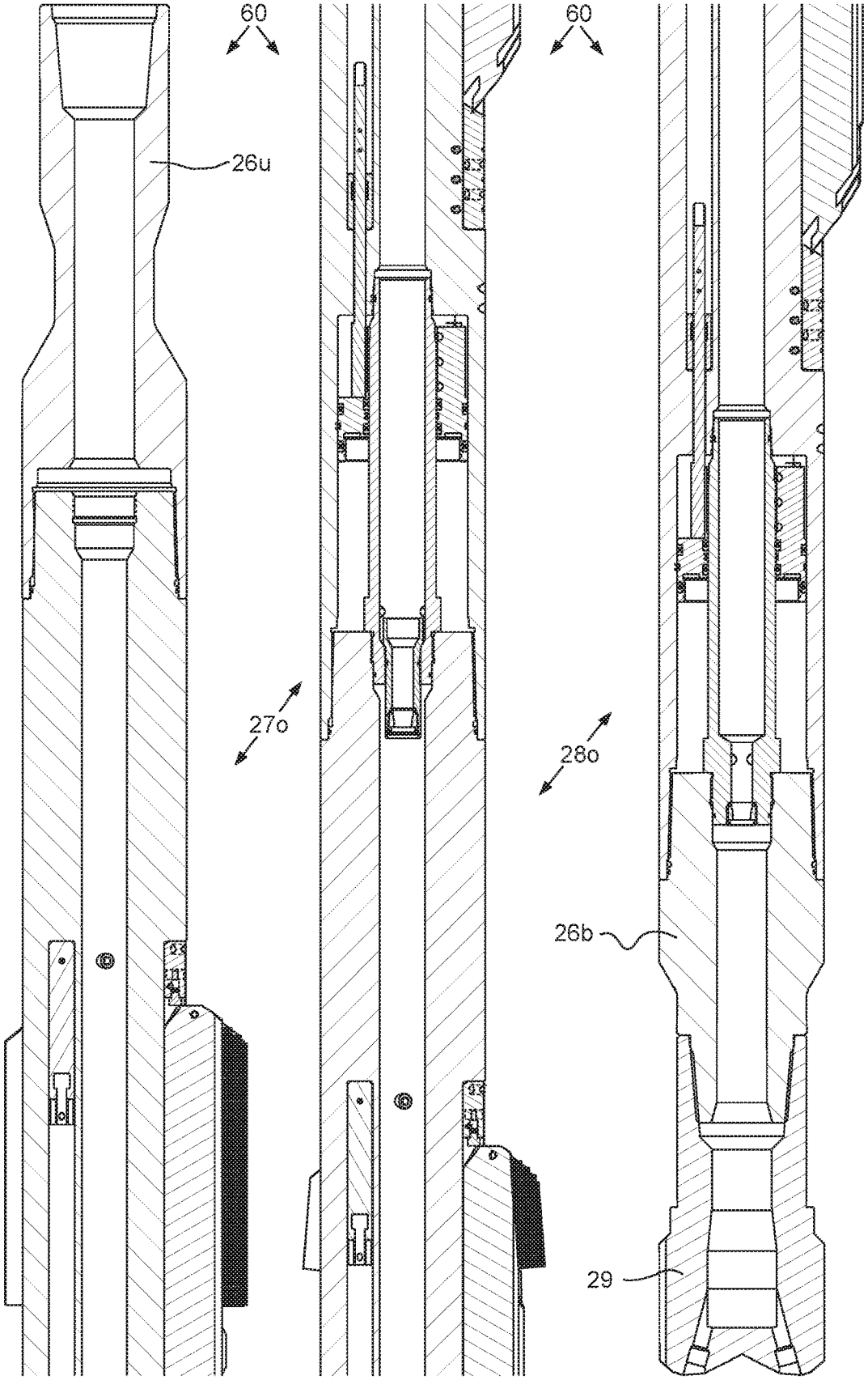
Figure 8G:
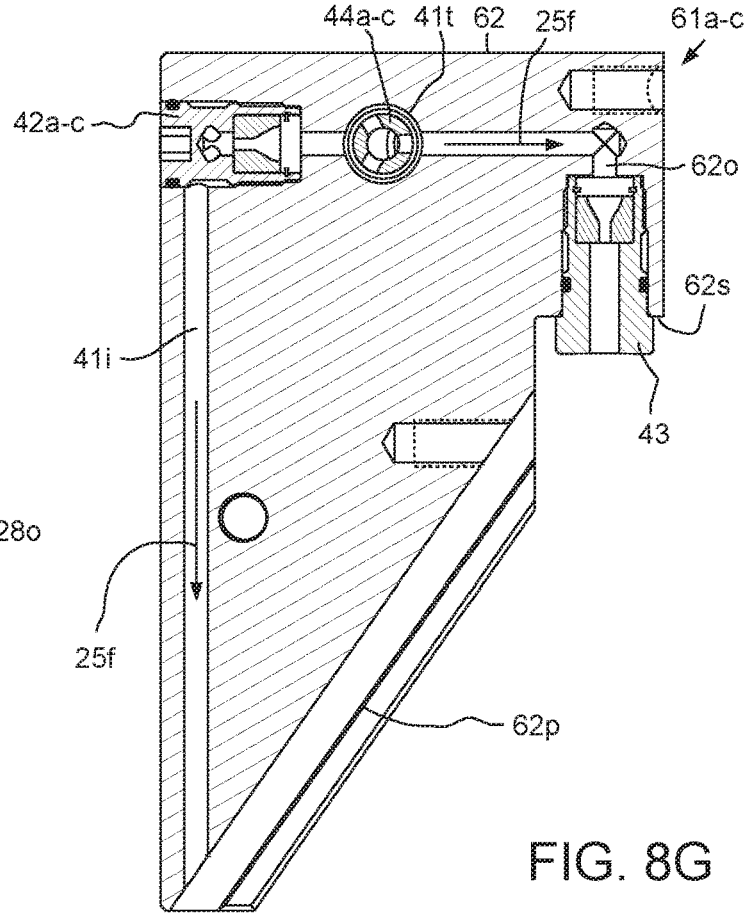
FIG. 8G illustrates upper blocks of the second BHA.

FIG. 8G illustrates upper blocks of the second BHA 60. The outer section mill 27*o* may be similar or identical to the inner section mill 27*i* except for the substitution of upper blocks 61*a-c* for the respective upper blocks 31*a-c*. The outer RCW mill 28*o* may be similar or identical to the inner RCW mill 28*i* except for the substitution of the upper blocks 61*a-c* for the respective upper blocks 31*a-c*. Each upper block 61*a-c* may be disposed in a respective pocket 30*k* and connected to the body 30, such as by one or fasteners. Each upper block 61*a-c* may include a body 62, the respective nozzle 42*a-c*, and the stop 43.

Figure 9B:
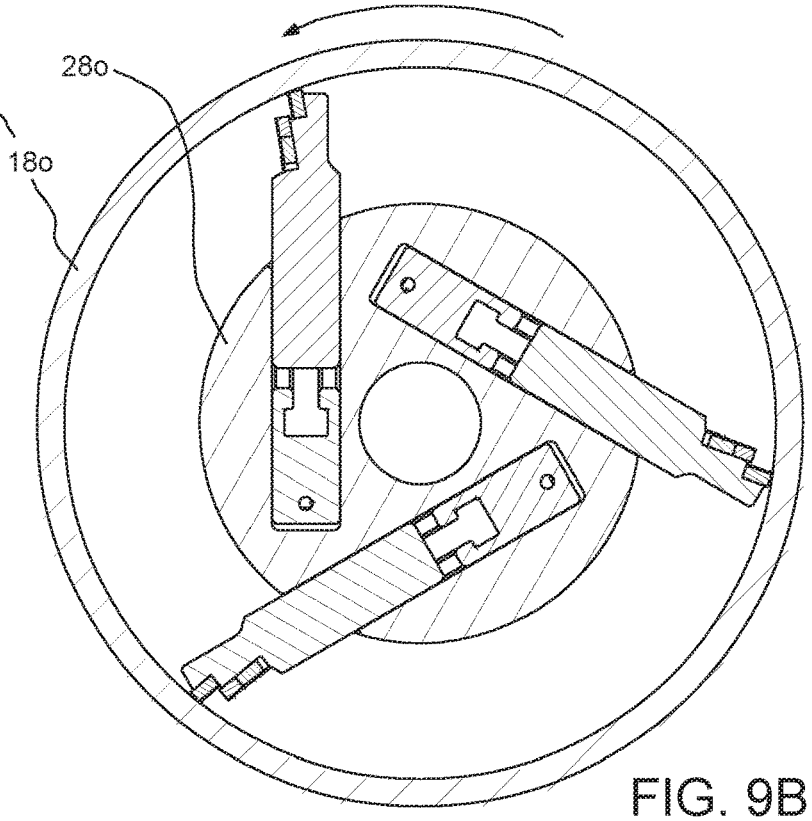
Figure 9C:
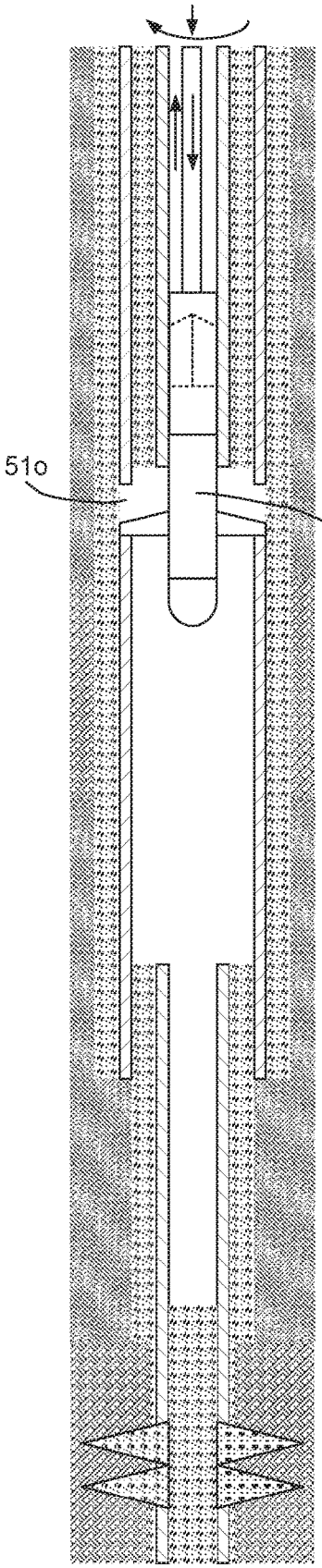
Figure 9D:
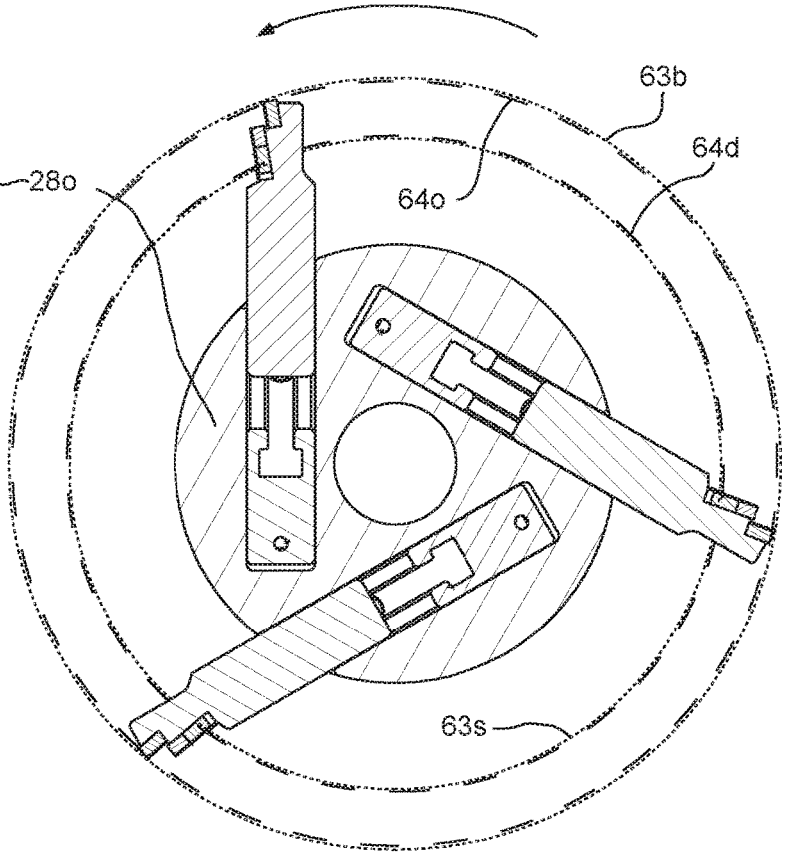

Each upper block body 62 may have a guide 62*p*, such as an inclined T-slot, formed in an inner and mid portion of a lower end thereof. Each guide 62*p* may be extended relative to the respective guide 41*p* for increasing a blade sweep 63*b* (FIG. 9D) and integral stabilizer sweep 63*s* to correspond to the outer casing string 18*o*. Each upper block body 62 may have a shoulder 62*s* formed in an outer portion of the lower end thereof adjacent to the guide 62*p*. Each stop 43 may be fastened to the respective upper block body 62 at the shoulder 62*s*. When extended, the blade sweep 63*b* of the outer mills 27*o*, 28*o* may be equal to or slightly greater than a coupling diameter 64*o* of the outer casing 18*o*. The sweep 63*s* of the pads 39*p*, 57 may be slightly greater than the drift diameter 64*d* of the outer casing 18*o* for engaging the inner surface thereof after the respective blade portions 38*d*, 56*d* have cut/extended through the outer casing.

Each upper block body 62 may have the inner passage 41*i* and an outer passage 62*o* formed therein and the port 41*t* formed therethrough. Each passage 41*i*, 62*o* may intersect the port 41*t*. The inner passage 41*i* may extend from the port 41*t* to the guide 41*p* for pressurizing the pocket 30*k* with milling fluid 25*f* from the housing bore to discourage infiltration of cuttings. The outer passage 62*o* may extend from the port 41*t* to the stop 43. Each body 62 may also have an inner threaded socket formed at a bend of the inner passage 41*i* for receiving the respective nozzle 42*a-c* and a second threaded socket formed at the respective shoulder 62*s* for receiving the respective stop 43. Due to a pressure drop across the nozzles 42*a-c*, the respective pocket 30*k* may be maintained at an intermediate pressure greater than pressure in the annulus 2*a* and less than pressure in the mill bore. Engagement of each stop shoulder 38*h* with the respective stop 43 may close the respective outer passage 62*o*, thereby causing an increase in standpipe pressure detectable by monitoring the supply pressure gauge 15*s* and confirming extension of the respective arms 32*a-c*, 52*a-c*.

Each outer mill 27*o*, 28*o* may further include the flow diverter 44*a-c* for each housing port 30*p*. Each housing port 30*p* may be a threaded socket for receiving a respective diverter 44*a-c* and each upper block port 41*t* may be a seal receptacle for receiving the diverter. Each diverter 44*a-c* may include a threaded plug having a bore formed therein and one or more crossover ports in fluid communication with the bore. Each diverter plug may carry a pair of seals straddling the crossover ports to isolate an interface between the respective diverter 44*a-c* and the upper block 61*a-c* and a seal to isolate an interface between the respective diverter and the housing 30.

FIGS. 9A-9D illustrate operation of the outer RCW mill 28*o*. The second BHA 60 may be assembled and deployed into the wellbore 2 using the conveyor string 7 through the inner casing 18*i* to the inner window 51*i*. The second BHA 60 is positioned in the wellbore 2 at a predetermined location near the top end of the inner window 51*i*. During deployment of the mill string, the milling fluid 25*f* may be circulated by the mud pump 21 at a flow rate less than the activation threshold. The second BHA 60 may be rotated 8*r* and injection of the milling fluid 25*f* may be increased to at least the activation threshold, thereby releasing the actuator 34 from the housing 30. The piston portion 45*p* may then move the pushers 46*a-c* upward and the arms 32*a-c* outward through the inner window 51*i* until cutters 39*c* of the outer row 40*c* engage the inner surface of the outer casing string 18*o*. During extension of the outer RCW mill 28*o*, the outer section mill 27*o* may be restrained from extension.

The blade portions 38*d* may engage the outer casing 18*o* and begin to radially cut through the outer casing wall. The milling fluid 25*f* may be circulated through the mill string and up the annulus 2*a* and a portion of the milling fluid 25*f* may be diverted into the upper blocks 61*a-c*. The second BHA 60 may be held longitudinally in place during the radial cut through operation. The supply pressure gauge 15*s* may be monitored to determine when the outer RCW mill 28*o* has radially cut through the outer casing 18*o* and started the outer window 51*o* as indicated by an increase in pressure caused by engagement of the arms 32*a-c* with the respective stops 43. The outer window 51*o* may extend entirely around and through the outer casing 18*o*. Weight may then be set down on the second BHA 60. The outer RCW mill 28*o* may then longitudinally open the outer window 51*o* while the pads 39*p* engage the inner surface of the outer casing 18*o*, thereby stabilizing the outer RCW mill. Longitudinal advancement of the outer RCW mill 28*o* may continue until the blade portions 38*d* are exhausted. Torque exerted by the top drive 9 may be monitored to determine when the blade portions 38*d* have become exhausted.

Figure 9E:
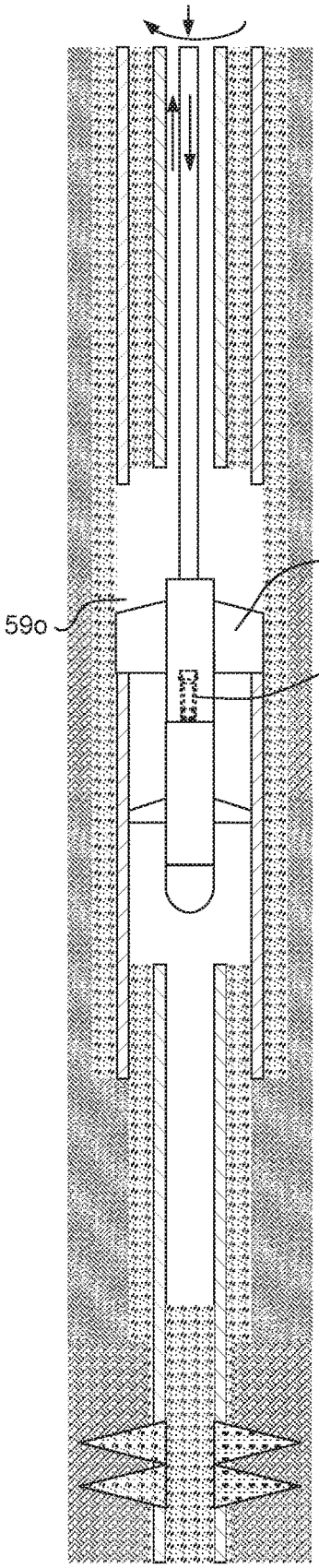
FIGS. 9E and 9F illustrate operation of a section mill of the second BHA.
Figure 9F:
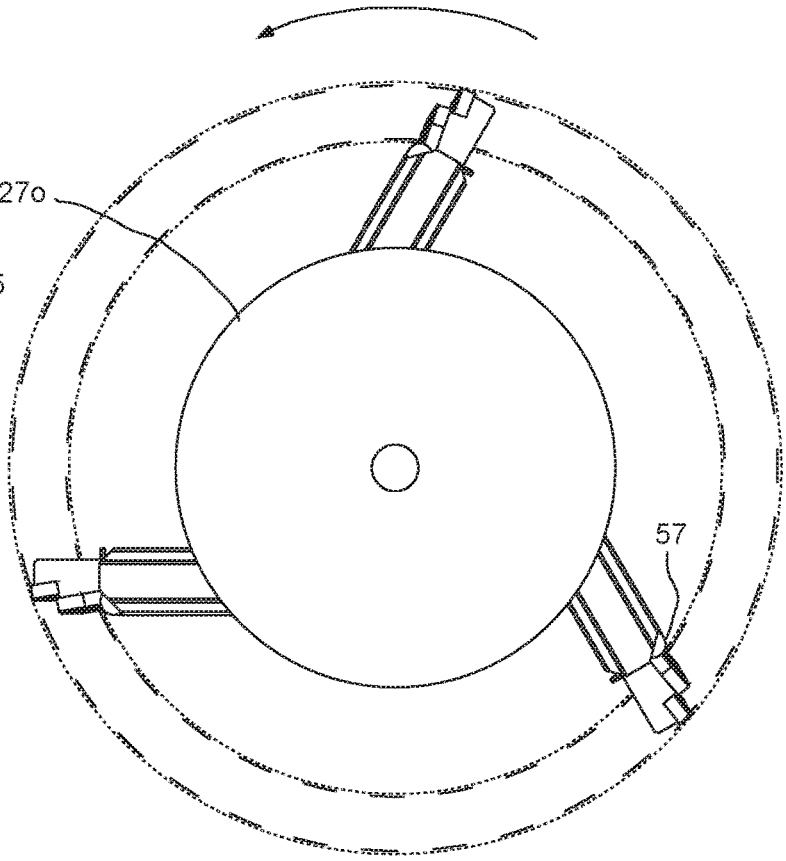

FIGS. 9E and 9F illustrate operation of the outer section mill 27*o*. Once the outer window 51*o* has been formed, rotation of the mill string may be halted. The outer section mill 27*o* may then be aligned with the outer window 51*o* or may already be aligned with the outer window. An upper portion of the conveyor string 7 may be disconnected and the dart 55 inserted into the mill string. The conveyor string 7 may then be reconnected and the mud pump 21 operated to pump the dart 55 downward through the conveyor string 7 and into the second BHA 60 until the dart engages the receiver 54*r*. An injection rate of the milling fluid 25*f* into the mill string may be increased until the second threshold is reached, thereby releasing the actuator 34.

The blade portions 56*d* may be extended through the inner and outer windows 51*i,o* by the actuator 34. The second BHA 60 may be rotated 8*r* and held longitudinally in place during extension of the arms 52*a-c*. The supply pressure gauge 15*s* may be monitored to confirm extension as indicated by an increase in pressure caused by engagement of the arms 52*a-c* with the respective stops 43. Weight may then be set down on the second BHA 60. The outer section mill 27*o* may then be advanced to longitudinally mill the outer section 59*o* while the pads 57 engage the inner surface of the outer casing 18*o*, thereby stabilizing the outer section mill. Longitudinal advancement of the outer section mill 27*o* may continue until the outer section 59*o* adjacent to the aquifer 20*a* is complete. The mill string may then be retrieved to the drilling rig 1*r*.

Figure 10A:
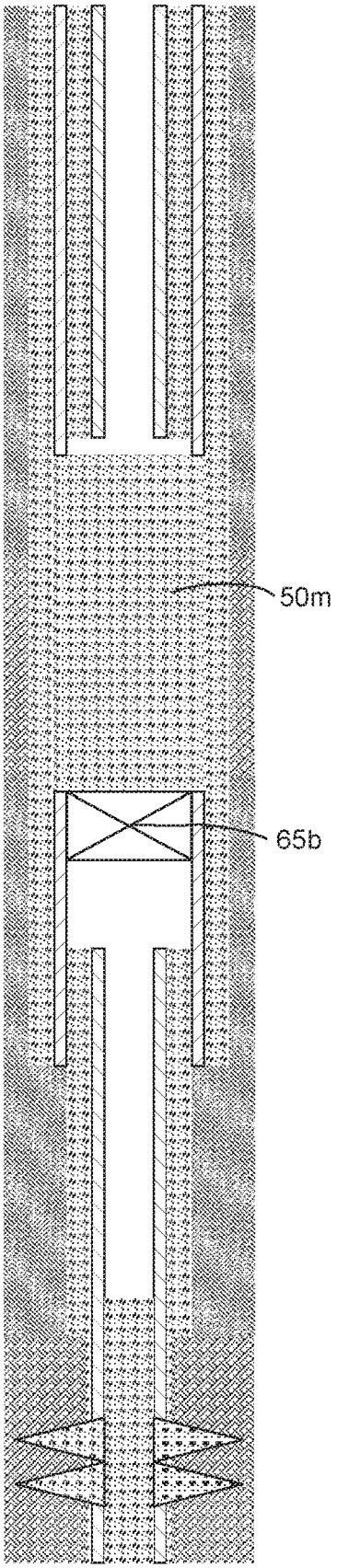
FIGS. 10A and 10B illustrate the wellbore plugged and abandoned.
Figure 10B:
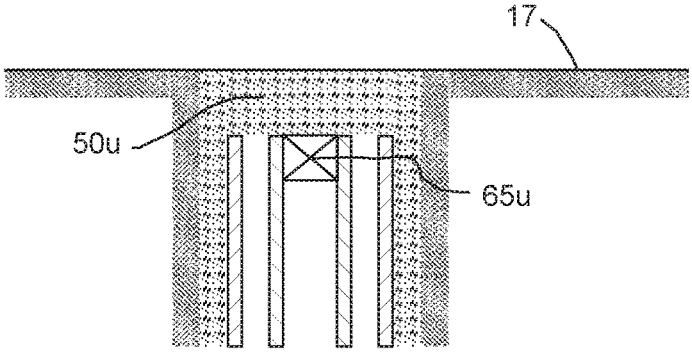

FIGS. 10A and 10B illustrate the wellbore plugged and abandoned. Once the sections 59*i,o* of the casings 18*i,o* have been milled, a BHA (not shown) may be connected to the conveyor string 7. The BHA may include the bridge plug 65*b*, a setting tool, and a cementing shoe/collar. The BHA may be run into the wellbore 2 using the conveyor string 7 to a depth proximately below a bottom of the aquifer 20*a*. The bridge plug 65*b* may be set using the setting tool by pressurizing the workstring. The setting tool may be released from the bridge plug 65*b*. Cement slurry may then be pumped through the workstring to displace wellbore fluid from the aquifer 20*a*. The workstring may then be removed from the wellbore 2 and the cement slurry allowed to cure, thereby forming the cement plug 50*m*. A casing cutter (not shown) may then be connected to the conveyor 7. The casing cutter may then be deployed a predetermined depth, such as one hundred feet, in the wellbore 2. The inner and outer casings 18*i,o* may be cut at the predetermined depth and removed from the wellbore 2. The bridge plug 65*u* may be set proximately below the cut depth and the cement slurry may be pumped and allowed to cure, thereby forming an upper cement plug 50*u*. The wellbore 2 may then be abandoned.

Figures 11A, 11B, 11C:
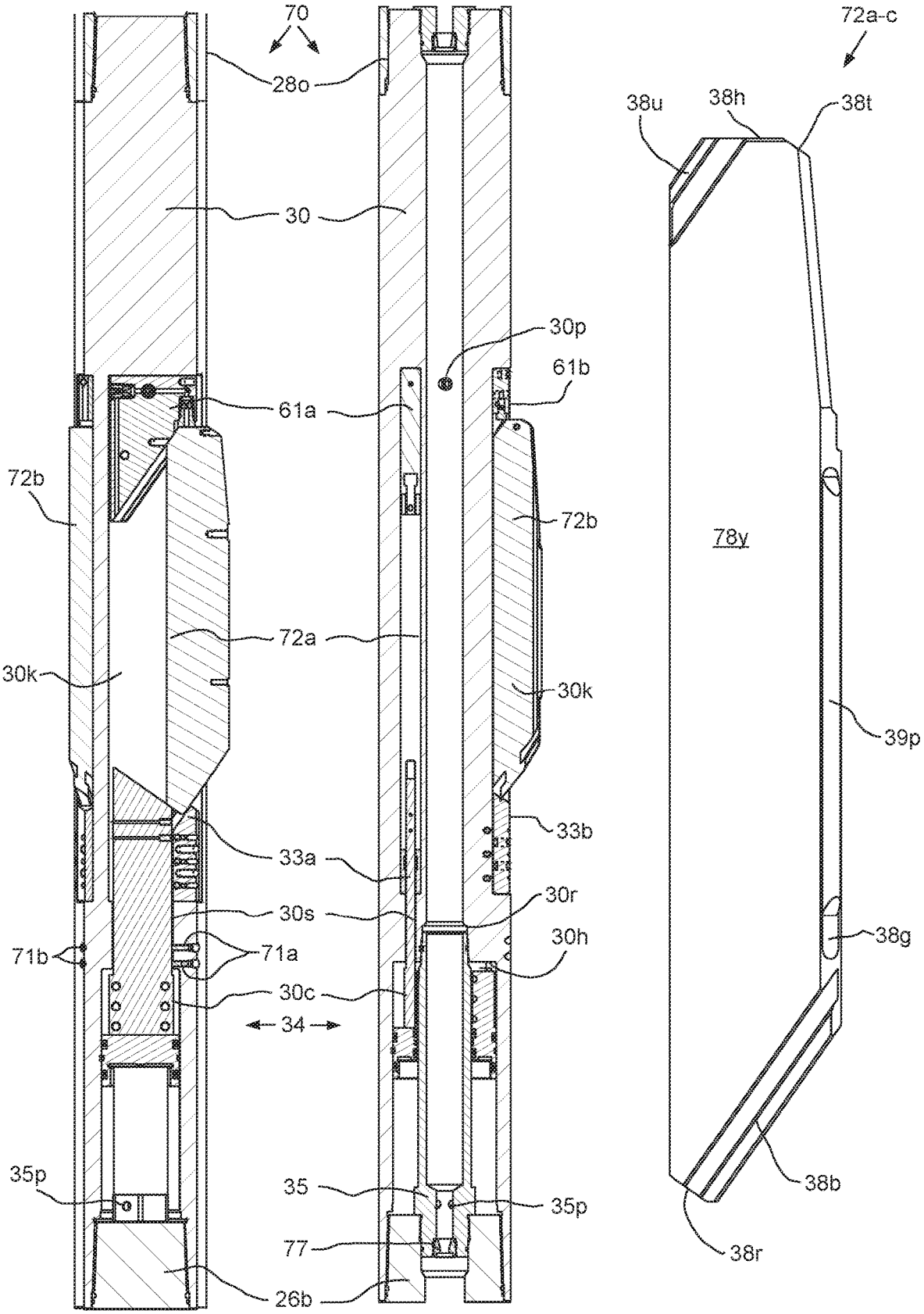
FIGS. 11A and 11B illustrate an optional hydraulically operated stabilizer for use with the second BHA, according to another embodiment of the present disclosure.
FIG. 11C illustrates arms of the hydraulically operated stabilizer.
Figure 12A:
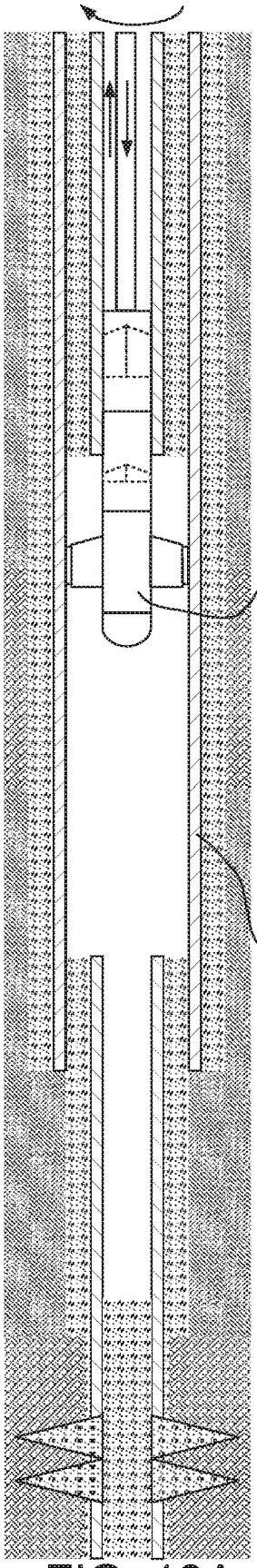
FIGS. 12A-12E illustrate hydraulic operation of the stabilizer with the second BHA.
Figure 12B:
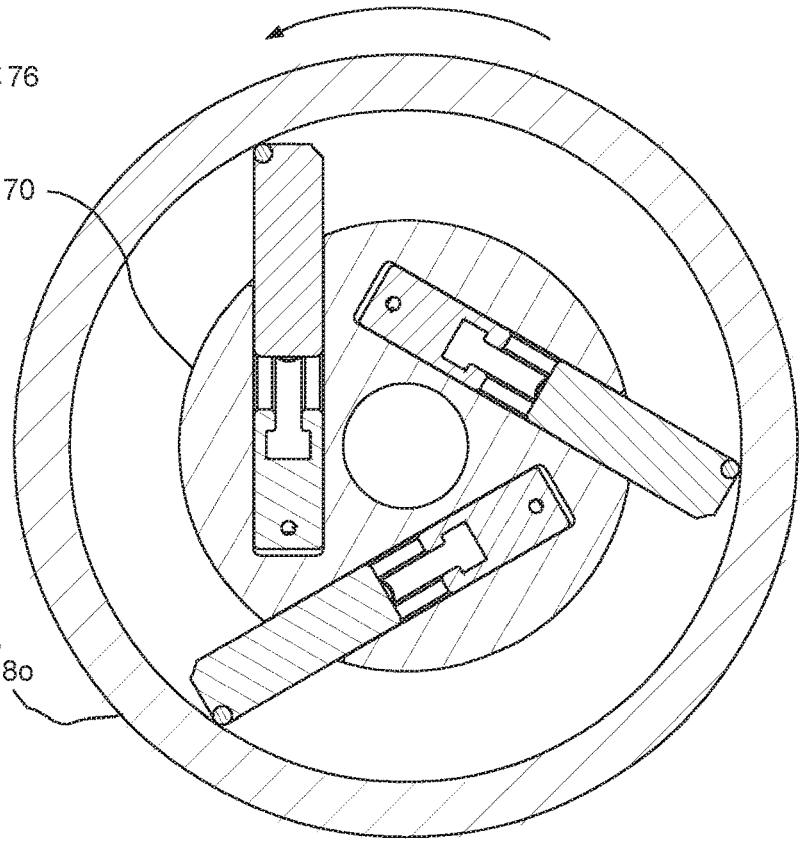
Figures 12C, 12D, 12E:
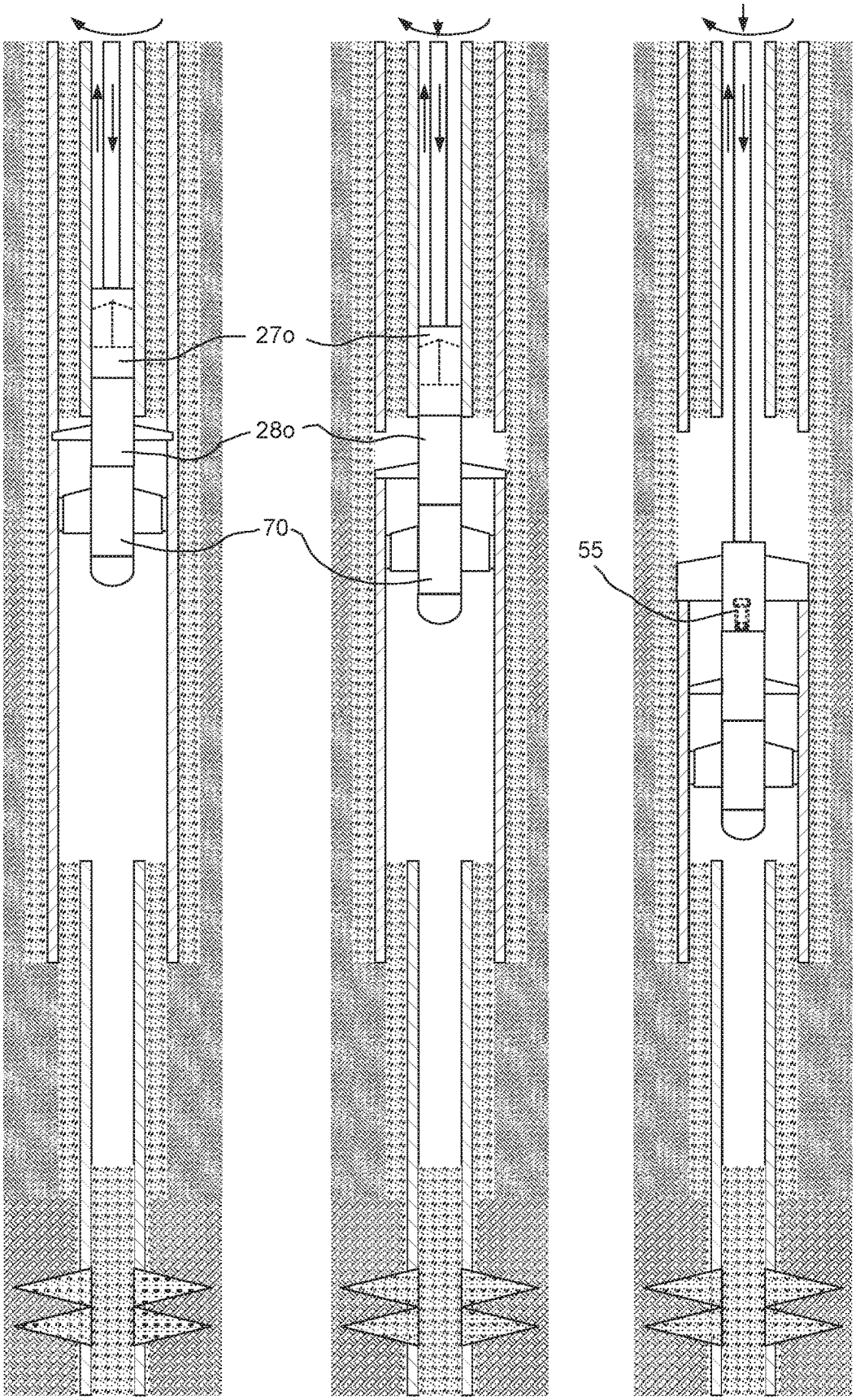

FIGS. 11A and 11B illustrate an optional hydraulically operated stabilizer 70 for use with the second BHA 60, according to another embodiment of the present disclosure. The stabilizer 70 may include the housing 30, the upper blocks 61*a-c*, one or more arms 72*a-c* (72*c* in FIG. 11C), the lower blocks 33*a,b* (third lower block not shown), the actuator 34, and the mandrel 35.

The nozzle 77 may be screwed into the mandrel 35 instead of the nozzle 37. The nozzle 77 may be made from an erosion resistant material and restrict flow of the milling fluid 25*f* therethrough to create a pressure differential between the mill bore and an annulus 2*a* formed between the mill string 3 and the inner casing 18*i* for operation of the actuator 34. The nozzle 77 may have an inner diameter less than the nozzle 37.

Each arm 72*a-c* may be movable relative to the housing 30 between a retracted position (not shown) and an extended position (FIGS. 11A and 11B). Each arm 72*a-c* may be disposed in the respective pocket 30*k* in the retracted position and at least a portion of each arm may extend outward from the respective pocket in the extended position. Each pocket 30*k* may be eccentrically arranged relative to the housing 30 and each arm 72*a-c* may have an eccentric extension path relative to the housing resulting in a far-reaching available sweep.

FIG. 11C illustrates arms 72*a-c* of the stabilizer 70. Each arm 72*a-c* may have an inner body portion 78*y*. Each body portion 78*y* may have the upper guide 38*u* and the lower guide 38*b* for interaction with the respective blocks 61*a-c*, 33*a,b* and the ramp 38*r* for interaction with the actuator 34. An outer portion of each body portion upper end may be inclined for serving as the retraction profile 38*t*. The retraction profile 38*t* may engage the inner casing string 18*i* (upper surface of the inner window 51*i*) for partially or fully retracting the arms 72*a-c* once milling of the outer casing string 18*o* is complete. Each body portion 78*y* may have the groove 38*g* formed along an outer surface thereof. The pad 39*p* may be pressed into each groove 38*g* and fixed into place, such as by welding. A sweep of the pads 39*p* may be slightly greater than the drift diameter of the outer casing 18*o* for engaging the inner surface thereof. Engagement of the pads 39*p* with the outer casing 18*o* may stabilize the mills 27*o*, 28*o*.

The stabilizer 70 may initially be restrained in the retracted position by one or more sets 71*a,b* (third set not shown) of one or more (two shown) shearable fasteners, such as pins. Collectively, the shear pins may fasten the actuator 34 to the housing 30 until the actuation force reaches a shear force necessary to fracture the shear pins and release the actuator from the housing. The actuation force may increase as an injection rate of milling fluid 25*f* through the mill string 3 is increased until the injection rate reaches a third activation threshold. The third shear force and third activation threshold may be less than those of the RCW mill 28*o* such that the stabilizer 70 extends before the mills 27*o*, 28*o*.

FIGS. 12A-12E illustrate hydraulic operation of the stabilizer 70 with the second BHA 60. The stabilizer 70 may be added to the second BHA 60 to form a third BHA 76. The stabilizer 70 may be located between the outer RCW mill 28*o* and the lower adapter 26*b*. The third BHA 76 may be assembled and deployed into the wellbore 2 using the conveyor string 7 through the inner casing 18*i* to the inner window 51*i*. The third BHA 76 is positioned in the wellbore 2 at a predetermined location near the top end of the inner window 51*i*. During deployment of the mill string, the milling fluid 25*f* may be circulated by the mud pump 21 at a flow rate less than the third activation threshold. The third BHA 76 may be rotated 8*r* and injection of the milling fluid 25*f* may be increased to at least the third activation threshold, thereby releasing and extending the stabilizer 70 into engagement with the inner surface of the outer casing string 18*o*.

The injection of the milling fluid 25*f* may be increased to at least the activation threshold, thereby releasing and extending the outer RCW mill 28*o* into engagement with the inner surface of the outer casing string 18*o*. The outer window 51*o* may then be opened and extended until the outer RCW mill 28*o* is exhausted. The stabilizer 70 may be engaged with the outer casing string 18*o* while the outer window 51*o* is opened and extended. Engagement of the stabilizer 70 with the outer casing string 18*o* may: center the third BHA 76 within the outer casing string, minimize or eliminate excess movement or play while allowing the third BHA to rotate freely within the outer casing string, and allow rotation of the third BHA within the outer casing string while limiting radial movement therein.

Once the outer window 51*o* has been formed, rotation of the mill string may be halted. The dart 55 may then be pumped to the outer section mill 27*o* and the milling fluid pumped to the third BHA 76 at the second threshold to release and extend the section mill through the inner and outer windows 51*i,o*. The outer section 59*o* may then be milled and the mill string retrieved to the drilling rig 1*r*. The stabilizer 70 may be engaged with the outer casing string 18*o* while the outer section 59*o* is milled.

Alternatively, the third activation threshold may be greater than or equal to the activation threshold or greater than or equal to the second activation threshold such that the stabilizer 70 may be released and extended simultaneously or after release and extension of the outer RCW mill 28*o* and/or the outer section mill 27*o*.

Figure 13:
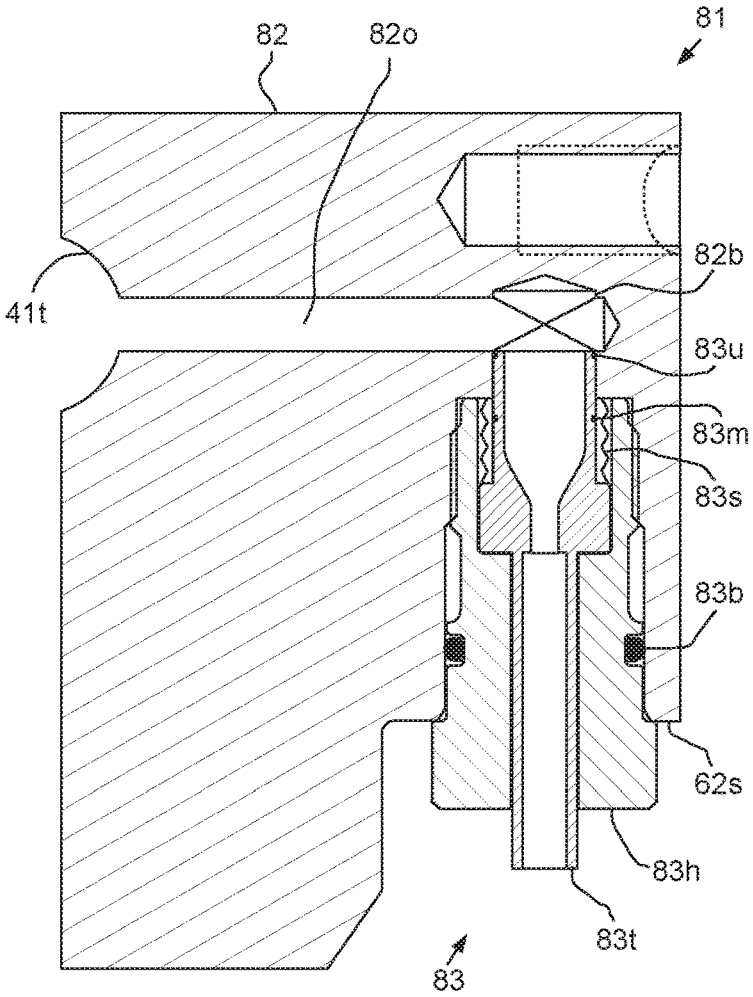
FIG. 13 illustrates an alternative upper block, according to another embodiment of the present disclosure.

FIG. 13 illustrates an alternative upper block 81, according to another embodiment of the present disclosure. An upper block 81 may be disposed in each respective pocket 30*k* and connected to the body 30 instead of the respective upper blocks 61*a-c* for the outer RCW mill 28*o*, outer section mil 27*o*, and the stabilizer 70. The upper block 81 may include a body 82, a nozzle similar to the nozzles 42*a-c*, and a stop 83.

The upper block body 82 may have a guide similar to the guide 62*p* formed in an inner and mid portion of a lower end thereof. The upper block body 82 may have the shoulder 62*s* formed in an outer portion of the lower end thereof adjacent to the guide. The stop 83 may be fastened to the upper block body 82 at the shoulder 82*s*. The upper block body 82 may have an inner passage similar to the inner passage 41*i* and an outer passage 82*o* formed therein and the port 41*t* formed therethrough. Each passage 82*o* may intersect the port 41*t*. The outer passage 82*o* may extend from the port 41*t* to the stop 83. The body 82 may also have a (second) threaded socket formed at the shoulder 62*s* for receiving the stop 83.

The stop 83 may include a housing 83*h*, a flow tube 83*t*, and a biasing member, such as a compression spring 83*s*. An interface between the housing 83 and the block body 82 may be isolated, such as by a seal 83*b*. The flow tube 83*t* may have an upper valve portion, a lower stinger portion, and a shoulder portion connecting the valve and stinger portions. The flow tube 83*t* may be longitudinally movable relative to the housing 83*h* and block body 82 between an open position (shown) and a closed position (not shown). The flow tube 83*t* may be biased toward the open position by the spring 83*s* disposed between the shouldered portion of the flow tube and the block body 82.

The housing 82*b* may have seal bore 82*b* formed as part of the outer passage 82*o* at a bend thereof. The valve portion of the flow tube 83*t* may carry a pair of straddle seals 83*u,m* on an outer surface thereof for closing the outer passage 82*o*. In the open position, the valve portion may be clear of the bend in the outer passage 82*o*, thereby allowing the flow of the milling fluid 25*f* therethrough. In the closed position, the seals 83*u,m* of the valve portion may engage the seal bore 82*b* and straddle a radial portion of the outer passage 82*o* while the valve portion extends across the radial portion, thereby closing the outer passage 82*o*. In the open position, the stinger portion of the flow tube 83*t* may protrude downward past a lower end of the housing 83*h* for receipt of the stop shoulder 38*h*. Engagement of the stop shoulder 38*h* with the stinger portion may overcome the bias of the spring 83*s* and push the flow tube 83*t* to the closed position, thereby causing an increase in standpipe pressure detectable by monitoring the supply pressure gauge 15*s* and confirming extension of the respective arms 32*a-c*, 52*a-c*, 72*a-c*.

Additionally, the upper blocks 31*a-c* of the inner mills 27*i*, 28*i* may be modified in a similar fashion.

Alternatively, either or both of the mandrel nozzles 37, 77 and/or the dart 55 may be omitted and nozzles of the drill bit 29 may be relied upon to create any of the activation thresholds instead. Alternatively, the guide shoe or reamer shoe alternatives for the drill bit 29, discussed above, may have nozzles for creating any of the activation thresholds.

Alternatively, the inner and outer mills may be deployed in the same trip or the inner or outer mills may be run for a single casing milling operation. Alternatively, instead of a plug and abandon operation, any of the BHAs may be used to form a window for a sidetrack or directional drilling operation. Alternatively, instead of casing strings, any of the BHAs may be used to mill one or more liner strings. Alternatively, instead of milling sections of the casing strings for plugs and leaving portions of the casing strings in the wellbore, the RCW mills may be used to remove the casing strings from the wellbore. Alternatively, instead of milling the entire casing string sections, a plurality of mini-sections may be milled in the casing strings.

Alternatively, each of the mills may include a control module for receiving instruction signals from the surface, thereby obviating the shear screws. Each control module may include a hydraulic or mechanical lock for restraining movement of the flow tube until the control module receives the instruction signal for releasing the flow tube from surface. The instruction signal may sent by modulating rotation of the workstring, modulating injection rate of the milling fluid, modulating pressure of the milling fluid (mud pulse), electromagnetic telemetry, transverse electromagnetic telemetry, radio frequency identification (RFID) tag, or conductors extending along the conveyor string. The control module may further include a transmitter for transmitting acknowledgment of the instruction signal, such as a mud pulser, electromagnetic or transverse electromagnetic transmitter, or RFID tag launcher. Each control module may further include a position sensor operable to monitor movement of the flow tube and the control module may transmit measurements of the position sensor to the telemetry sub for relay to the surface.

While the foregoing is directed to embodiments of the present disclosure, other and further embodiments of the disclosure may be devised without departing from the basic scope thereof, and the scope of the invention is determined by the claims that follow.

The invention claimed is:

1. An apparatus for use in a wellbore, comprising:

a tubular housing having a bore therethrough and a plurality of eccentrically arranged pockets formed in a wall thereof;

an arm disposed in each pocket, each arm including a body portion and movable between an extended position and a retracted position;

a block disposed in each pocket and connected to the housing, each block having:

a guide engaged with a mating guide of the respective body portion;

a body and a stop connected thereto for receiving the respective arm in the extended position; and an outer passage for providing fluid communication between the bore and the respective stop; and wherein each arm is operable to close the respective outer passage in the extended position.

2. The apparatus of claim 1, wherein each arm is configured to engage an outer casing string in the wellbore.

3. The apparatus of claim 2, wherein each arm includes a pad configured to engage the outer casing string.

4. The apparatus of claim 1, wherein each arm is configured to extend through a window of an inner casing string in the wellbore.

5. The apparatus of claim 1, wherein each arm includes a blade portion, the blade portion extending from an outer surface of the body portion.

6. The apparatus of claim 1, each stop having a valve operable to close the respective outer passage in response to extension of the respective arm.

7. A method of cutting an outer casing string having an interior surface, the outer casing string located in a wellbore, the method comprising:

deploying a workstring having a bottom hole assembly into the wellbore through an inner casing string, the bottom hole assembly including a first mill and a stabilizer located below the first mill, wherein:

the first mill and the stabilizer each comprise:

a tubular housing having an upper end, a lower end, a central flow bore continuous from the upper end to the lower end, and a longitudinal axis;

a plurality of circumferentially spaced openings formed in the housing; and a plurality of arms, each arm:

located within a corresponding one of the plurality of openings, having an arm length oriented substantially parallel to the longitudinal axis, and movable with respect to the corresponding opening between retracted and extended positions while the arm length is maintained substantially parallel to the longitudinal axis;

extending arms of the stabilizer and arms of the first mill past an exterior surface of the inner casing string and into engagement with the interior surface of the outer casing string;

then operating the first mill to sever the outer casing string, thereby producing an outer casing window between upper and lower outer casing portions; and then operating the first mill to longitudinally extend the outer casing window by milling a first section of the lower outer casing portion.

8. The method of claim 7, further comprising centering the bottom hole assembly within the outer casing string with the arms of the stabilizer.

9. The method of claim 7, wherein:

extending the arms of the first mill occurs after engaging the outer casing string with the arms of the stabilizer; and the arms of the first mill and the arms of the stabilizer are extended through a window or milled section of the inner casing string.

10. The method of claim 7, further comprising providing fluid pressure in the bottom hole assembly at a first threshold to extend the arms of the stabilizer.

11. The method of claim 10, further comprising providing fluid pressure in the bottom hole assembly at a second threshold to extend the arms of the first mill.

12. The method of claim 11, wherein the second threshold is greater than or equal to the first threshold.

13. The method of claim 7, further comprising extending arms of a second mill to engage the outer casing string, and operating the second mill to longitudinally extend the outer casing window by milling a second section of the lower outer casing portion.

14. The method of claim 13, wherein the stabilizer is engaged with the lower outer casing portion while operating the second mill to mill the second section of the lower outer casing portion.

15. An apparatus for milling an outer casing string having an interior surface, the outer casing string surrounding an inner casing string, the apparatus comprising:

a mill and a stabilizer, wherein the mill and the stabilizer each comprise:

a tubular housing having an upper end, a lower end, a central flow bore continuous from the upper end to the lower end, and a longitudinal axis;

a plurality of circumferentially spaced openings formed in the housing; and a plurality of arms, each arm:

located within a corresponding one of the plurality of openings, having an arm length oriented substantially parallel to the longitudinal axis, movable with respect to the corresponding opening between retracted and extended positions while the arm length is maintained substantially parallel to the longitudinal axis, and wherein the mill further comprises a blade associated with each arm; and wherein the arms of the stabilizer are configured to extend past an exterior surface of the inner casing string and engage the interior surface of the outer casing string prior to the blades of the mill severing the outer casing string.

16. The apparatus of claim 15, wherein the arms of the mill and the arms of the stabilizer each have an outer surface including an engagement material, the engagement material being harder than a material of the outer casing.

17. The apparatus of claim 16, wherein the engagement material is in the form of a pad.

18. The apparatus of claim 16, wherein the engagement material on the outer surface of the arms of the mill extends along a portion of the arm lengths of each arm of the mill, and the engagement material on the outer surface of the arms of the stabilizer extends along a portion of the arm lengths of each arm of the stabilizer.

19. The apparatus of claim 15, wherein the mill is movable between a deployment configuration and a casing cutting configuration, and wherein when the mill is in the casing cutting configuration, a lateral blade sweep dimension is at least equal to a coupling diameter of the casing.

20. The apparatus of claim 15, wherein the stabilizer is movable between a deployment configuration and a stabilizing configuration, and wherein when the stabilizer is in the stabilizing configuration, a lateral sweep dimension is at least equal to a drift diameter of the casing.

21. The apparatus of claim 15, wherein each opening defines a pocket.

22. The apparatus of claim 21, wherein each pocket is eccentrically arranged relative to the tubular housing.

* * * * *